US008312964B2

(12) United States Patent
Harris, Jr.

(10) Patent No.: US 8,312,964 B2
(45) Date of Patent: Nov. 20, 2012

(54) PERSONAL EMERGENCY DESCENDER SYSTEM AND METHODS OF USE

(76) Inventor: Rano J. Harris, Jr., Spanish Fort, AL (US)

( * ) Notice: Subject to any disclaimer, the term of this patent is extended or adjusted under 35 U.S.C. 154(b) by 429 days.

(21) Appl. No.: 12/619,040

(22) Filed: Nov. 16, 2009

(65) Prior Publication Data

US 2010/0122874 A1 May 20, 2010

Related U.S. Application Data

(63) Continuation-in-part of application No. 11/099,373, filed on Apr. 5, 2005, now Pat. No. 8,061,479.

(60) Provisional application No. 61/193,296, filed on Nov. 14, 2008, provisional application No. 60/559,936, filed on Apr. 6, 2004.

(51) Int. Cl.
*A62B 1/16* (2006.01)

(52) U.S. Cl. ..... 182/3; 182/187

(58) Field of Classification Search ..... 182/3, 187
See application file for complete search history.

(56) References Cited

U.S. PATENT DOCUMENTS

| | | | | |
|---|---|---|---|---|
| 946,588 | A * | 1/1910 | Thuener | 188/65.4 |
| 1,574,529 | A * | 2/1926 | Abraham | 182/7 |
| 4,662,475 | A * | 5/1987 | Rutschi et al. | 182/5 |
| 5,145,028 | A * | 9/1992 | Wai | 182/5 |
| 5,295,559 | A * | 3/1994 | Nutkins | 188/65.4 |
| 6,832,668 | B2 * | 12/2004 | Henson | 182/236 |
| 8,061,479 | B2 * | 11/2011 | Harris, Jr. | 182/3 |

* cited by examiner

*Primary Examiner* — Katherine W Mitchell
*Assistant Examiner* — Candace L Bradford
(74) *Attorney, Agent, or Firm* — Clark & Brody

(57) ABSTRACT

A self-rescue system and a method for providing self-rescue to fall-victims suspended in fall-arresting safety harnesses following an accidental fall enables such suspended fall victims to descend to the ground or other place of safety at a controlled, safe velocity, without assistance from anyone else. In addition, the invention can also address applications in many types of elevated locations where a controlled descent is needed in order to escape emergency conditions.

16 Claims, 23 Drawing Sheets

PERSONAL EMERGENCY DESCENDER SYSTEM AND METHODS OF USE

This application claims priority under 35 U.S.C. 119(e) based on provisional application No. 61/193,296 filed on Nov. 14, 2008 and is a continuation-in-part application based on application Ser. No. 11/099,373 filed Apr. 5, 2005, now U.S. Pat. No. 8,061,479 which claims priority under 35 U.S.C. 119(e) based on provisional application No. 60/559,936 filed on Apr. 6, 2004, both applications are incorporated by reference in their entirety herein.

FIELD OF INVENTION

This invention relates generally to the field of fall protection systems and methods, and more particularly to the field of self-rescue systems which provide safe emergency descent from elevated positions.

BACKGROUND ART

Many thousands of individuals work in locations and positions which are elevated above the ground or above some other safe platform located above the ground. Likewise, many individuals, such as deer hunters who hunt from treestands, rock climbers, and others engage in a variety of recreational activities in elevated positions above the ground. In such elevated positions, the risk of injury or death from an accidental fall is a real and ever-present concern. Numerous designs for various types of fall-arrest systems have been developed over the years to protect workers and others from sustaining impact injuries or death in the event of accidental falls from elevated locations. One of the most common and widely-used fall-arrest systems is the so-called "full-body safety harness", which typically comprises an assemblage of webbing components configured to be worn by the user, with leg straps and a waist belt for support of the torso. A tether attached to the harness is generally connected to an anchor point above the user's head. In the event of a fall, the harness is designed to arrest the person's fall, and to provide support until rescue from the suspended condition can be achieved.

In recent years, experience and research have taught that a person who remains suspended in a safety harness after an arrested fall runs an extremely high risk of experiencing suspension trauma. Suspension trauma refers to the sequence of events likely to be experienced by a suspended fall victim after an arrested fall, as a result of the interruption of blood flow to and from the lower extremities. This circulatory interruption is commonly caused by the impingement of the leg straps on the large arteries and veins of the upper leg and groin region. The condition arises soon after becoming suspended in a harness after a fall, and begins with pain in the groin region, then progresses to loss of feeling in the feet or toes of the victim, then to loss of feeling in the legs, followed by unconsciousness. Death due to circulatory insufficiency is the ultimate result, unless the victim can be rescued immediately after the fall. The longer the fall victim remains suspended, the greater the danger. Indeed, the danger of suspension trauma has only become widely known within the past several years. The condition is now being addressed as a serious risk, through revised ANSI standards for fall-protection systems and equipment. Likewise, it is a subject of serious concern to the Consumer Products Safety Commission, due primarily to the likelihood of the condition affecting hunters who fall from treestands, even thought their harnesses may have prevented them from impact injury or death.

If there is no outside assistance available to provide for the rescue of a suspended fall victim, then the preferred approach to avoiding suspension trauma is through some means of rapid self-rescue. Self-rescue involves enabling the fall victim to return to a place of safety quickly, without assistance. Immediate self-rescue after a fall is the key to improved survival chances. Self-rescue is particularly important in the case of hunters and workers who are working alone without nearby and available sources of assistance. The current invention is designed to provide self-rescue by providing a safe and gentle descent back to the ground or other safe platform just as soon as the fall has been arrested.

Fall-protection devices and emergency descent systems related to fall protection are well-known in the art, and date back for many decades. Such devices generally exhibit one or more limiting characteristics which render them inappropriate for use as a personal, automatic emergency descent system. Such limiting characteristics include (1) dependence on operator activation, control, and technique, usually requiring elaborate training (2) a requirement for the user to be agile and/or athletic in order to safely use such systems, (3) either overly complex or overly simplistic designs which are not sufficiently user-friendly to ensure safe operation.

Descender systems designed for emergency descent from a stationary anchor point, usually in industrial environments, are also well-known, as illustrated by United States Published Patent Application No. 2002/0179372, which discloses an exceedingly complex, heavy, and expensive device. Its complexity would predictably lead to high cost and possibly compromised reliability. Further, the device is far too large and heavy to be used by great numbers of people in diverse circumstances, or in applications where the system needs to be easily transportable, perhaps to remote locations. This system and others do not meet the parameters of a "personal" self-rescue device which is highly affordable, compact, lightweight, user-friendly, simple, and reliable. Devices which do not meet these requirements would be very difficult to market, due to high cost and low user acceptance levels, except in certain very high-end industrial environments. In short, such systems have not been welcomed and acquired by large numbers of the users who actually do need to be using such protective gear.

A number of other designs have been proposed over the years to address the area of self-rescue, but the majority of these, especially those which involve mountaineering or climbing-type devices or systems, demand training skill, athleticism, and precise techniques on the part of the user. In many cases, because of their common use of heavy climbing ropes, they tend to be complicated, cumbersome, bulky, and expensive systems, well-suited for only a minority of the people who might need them.

No other system known provides the capability and convenience, as the present invention does, for the descender/self-rescue device to be worn or used continuously and comfortably by the wearer, or the ability to automatically lower a fall victim who may be unconscious or disabled. A personal descender which involved a stored coil of webbing and attempted to use a rappelling-rack-based braking system, was introduced in approximately 2003 (The Fall Guy Descender, as mentioned in United States Published Patent Application No. 2006/0113147), but the device was removed from the market due to various difficulties. Other rappelling-type devices with bags for storage of the rappelling line are known, but again, virtually all of these require the user to employ a certain degree of skill and athleticism in initiating the descent.

Personal descender designs are not unknown in the art. Few of these have found commercial success outside the industrial and commercial arenas. One type of a personal descender employs a stored line used in conjunction with a separate device which employs a helical groove around a body through which the line is pulled upon initiation of a descent, which arrangement provides a frictional resistance to payout of the line. However, the this type of a system involves many highly-precise, complex, costly, interconnecting, and close-fitting parts, and does not integrate the stored line with the braking mechanism into one, compact, simple, lightweight and affordable module, as the present invention does.

While differing types of emergency escape and descent systems are known in the art, such descenders are most often designed to be attached to an anchor point, to which a user would connect some type of harness tether, for the purpose of descending from an elevated location in the event of an emergency. Most are not designed to anticipate or to accommodate the needs of a worker or person involved in activities and moving around at various heights who might sustain an accidental fall at any time or in any place where he or she might be working. Further, such industrial descenders are (a) not designed to be worn in conjunction with or as part of a safety harness, (b) are typically too large and heavy (15 to 25 lbs., for example) to be practical for workers to wear or carry around, and (c) are exceedingly expensive, costing $1,200 to as much as $2,500 each, and (d) are typically very complex, involving many expensive precision moving parts. By contrast, the present invention in a preferred version weighs approximately 1.5 lbs, is very compact (comparable to a compact-disc player in size), utilizes no moving parts other than the descent webbing, and is very economical.

SUMMARY OF THE INVENTION

The present invention comprises a self-rescue system and a method for providing self-rescue to fall-victims suspended in fall-arresting safety harnesses following an accidental fall, by enabling such suspended fall victims to descend to the ground or other place of safety at a controlled, safe velocity, without assistance from anyone else. In addition, the invention can also address applications in many types of elevated locations where a controlled descent is needed in order to escape emergency conditions.

In a preferred embodiment, the system of the invention comprises a descender unit which may be attached to an anchor point above where a person is working or otherwise engaged, which descender incorporates a simple braking system and a stored quantity of emergency-descent line, cable, or webbing, all of which components are integrated into a sealed module. The outer terminal end of the descent line protrudes through a sealed opening at the bottom of the descender, and is in turn secured to the tether of the user's safety harness. If the user should fall, the weight of the user causes the descent line to be pulled out of the descender module, while the braking mechanism restricts the rate of payout of the descent line to a safe, gradual rate, thereby safely supporting the user as he or she descends safely back to the ground or to another safe intermediate platform above the ground.

In a second preferred embodiment, the system may be configured in an inverted orientation for adaptation to and integration into a fall-arresting safety harness. In such configuration, the outer terminal end of the descent line extends upward and merges into the tether, the upper, distal end of which is connected via an anchor-attachment strap to an upper anchor point, exactly as with conventional safety harnesses. In such configuration, the descender remains with the user continuously, in an unobtrusive, comfortable location, so that no matter where the person anchors the tether, as long as such anchor and attachment are secure, the person enjoys built-in full-time fall-arrest AND self-rescue (controlled descent) capability.

In such embodiment, the full-body safety harness is equipped with molded or formed padding sections in the rear, in which the braking unit and container are nestled, configured to surround and conceal the system, to minimize its presence, and the ability of the wearer to feel and detect it. Such padding is also used to provide back cushioning for extra comfort, and in combination with the system, serves as a lumbar support for the wearer.

In the above preferred embodiments, the descender module also incorporates an improved system for supporting the load-bearing components of the descender and protecting the sealed housing against excessive loads during a fall and subsequent controlled descent. The improved support system incorporates an "outside-the-box" yoke system, which transfers the great majority of the force of a fall or descent to the internal load-bearing members, without putting undue strain on the outside sealed enclosure housing. In addition, the improved support system is adaptable to a variety of connectors and end-effect terminations to enable simple attachment to various types of anchor points and safety harnesses.

A primary object of the invention is to provide a simple, reliable, means of self-rescue to a fall-victim who is suspended in a safety harness after experiencing a fall that has been arrested by the safety harness.

Another primary object of the invention is to provide a controlled-descent system for use by persons working at heights above the ground, so that in the event of a fall such persons will be able to rescue themselves without assistance from others, thereby avoiding the onset of suspension trauma and the injury or death which it can cause.

Another object of the invention is to provide a compact, lightweight, and affordable controlled descent system, in order to maximize usage of such descent system by those who need, and should be using, such a system.

A further object of the invention is to provide a compact, lightweight personal descender unit which can be used by the current owners of various types of safety harnesses, simply by being able to attach such descender unit to a tree or other anchor point.

A further object of the invention is to provide a compact, lightweight personal descender system which can be incorporated into or attached to a fall-arresting safety harness so that the harness can function exactly as any conventional harness, with the added benefit of providing continuous, full-time self-rescue fall protection, in addition to the fall-arrest capability normally provided by the harness.

A further object of the invention is to provide a compact, lightweight personal descender system which incorporates an improved mounting and support system, to maximize strength of the system, and to keep the downward loads of the initial drop of the wearer during a fall from being imposed on the weatherproof enclosure, but supported by webbing and strong mechanical components, instead.

A further object of the invention is to provide a shock-absorbing capability which will reduce the impact loads on the user during a fall, at the point where the user reaches the limit of the length of the initial, uncontained tether. Such shock-absorption to reduce the fall-impact forces on the body of the wearer when he or she reaches the end of the tether is now commonly provided by the tether having stitched tear-away sections or tear-apart woven or non-woven materials which deploy sequentially to slow the fall victim prior to impact with the end of the tether. The current invention further lowers such shock impact loads upon the user's body, increasing the safety of the fall victim, and could be used either in conjunction with or instead of the conventional shock-absorbing tether units.

A primary advantage of the invention is its small size and light weight.

Another advantage of the invention in its first preferred embodiment is that it integrates the stored length of line as well as the braking mechanism for the line into a compact, unitary, weatherproof module, which incorporates a novel and easy to use mounting system.

A further advantage of the invention is the simplicity of the braking system, involving only a novel array of stationary friction-inducing members inside the enclosure, configured in a unique geometry around or adjacent to the webbing coil, and utilizing the well-known and proven-reliable friction-inducing concept of winding the descent line among the friction-inducing members in a back-and-forth path.

A further advantage of the invention is the novel geometric layout of the array of friction-inducing components of the braking system, which involves no moving parts for ultimate simplicity and reliability, as well as the unique positioning and layout of such components with respect to the stored descent line, to enable an extremely compact, simple, reliable, and user-friendly emergency descent system.

A further advantage of the invention is that it employs an array of tubular or hollow friction inducing components, to dissipate the heat of friction generated during a descent better than existing and conventional designs.

A further advantage of the invention incorporating an improved mounting and support system is to enable and to ensure that forces during a fall or descent are maintained in a straight-line direction, from the anchor point, through the descender module braking system, and ultimately to the tether, without side-loading or mis-alignment which could cause undesirable and unpredictable forces to be applied to the components.

A further advantage of the invention incorporating an improved mounting and support system is that the improved support system, when constructed of high strength webbing with metal support plates, is lighter in weight, more economical, and stronger than comparable systems made of metal alone.

A further advantage of the invention incorporating an improved mounting and support system is that it is readily adaptable to a range of different types of attachment fittings and connectors, to facilitate quick and easy attachment to or detachment from a tree or other anchor point, or a fall-arresting safety harness A further advantage of the invention is that in a preferred embodiment, the braking mechanism comprising an array of friction-inducing members housed within the descender module enclosure incorporates a geometry which facilitates altering the path followed by the descent line among the friction-inducing members during manufacturing, thereby enabling the application of more or less frictional resistance to the rate of payout of the descent line, which amount of frictional resistance may be selected according to the weight of the intended wearer.

DETAILED DESCRIPTION OF THE DRAWINGS

The following descriptions of various embodiments of the invention are merely exemplary in nature, and are in not way intended to limit the invention, its designs, constructions, or uses.

Figure 1:
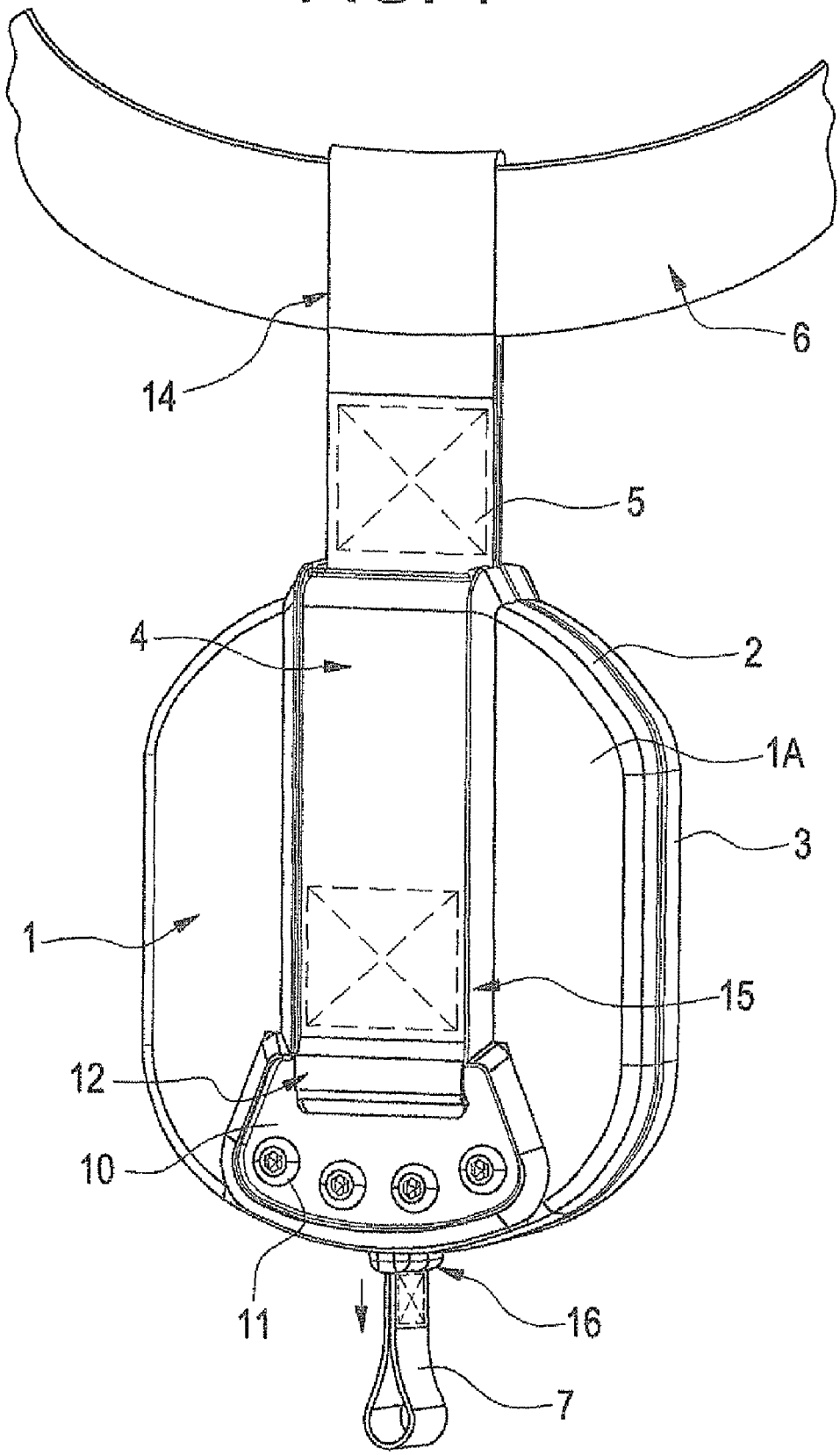
FIG. 1 is a perspective view showing an external view of a preferred embodiment of the invention, including the improved support and mounting system, showing a strap for attaching the descender to a tree trunk, pole, or other elevated anchor point.
Figure 2:
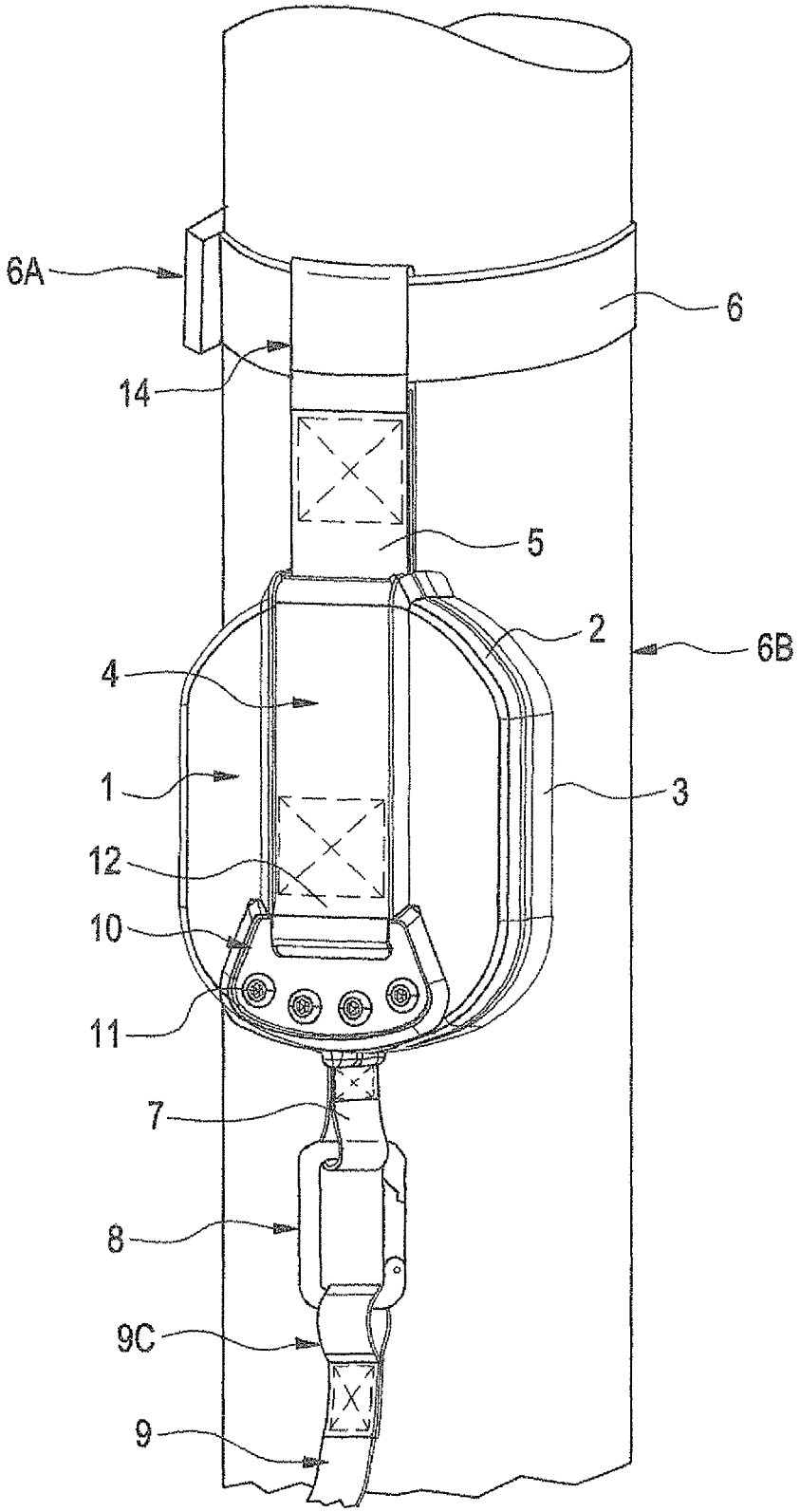
FIG. 2 is a perspective view showing an external view of a preferred embodiment of the invention deployed upon a pole or tree-trunk or other structure, and attached thereto by an anchor strap, and further disclosing the weather-resistant housing, the improved support system, the distal, terminal end of the stored length of descent line, which main store of line is housed within said enclosure, a carabineer used to connect the distal, terminal end of the descent line to a shock absorbing tether which is attached to a fall-arresting safety harness.

Referring to FIGS. 1 and 2, an emergency descender 1 is illustrated. Millions of workers in industrial and commercial environments in the United States and other countries are often required to work at heights above the ground, as in roofing, construction, and other similar applications. Such workers at heights above the ground are constantly at risk of sustaining accidental falls which can result in serious injuries or death. As such, fall-protection devices such as fall-arresting safety harnesses anchored to stationary anchor points are required to be worn by such workers to protect them against such injuries or deaths from falls. In addition, literally millions of hunters pursue wild game while hunting from elevated platforms of various types, which platforms are known as treestands. While the descender 1 can provide a degree of fall-arrest protection for either a worker, a hunter, or some other person engaged in an activity at heights above the ground or above a safe platform, its primary purpose is to provide such person with a safe, comfortable descent back to the ground or an intermediate safe platform above the ground in the event that such person sustains a fall, and is connected to the device via a fall-arresting safety harness, safety belt, or other such garment or device.

Such a controlled-rate descent is commonly described as a "self-rescue" after an arrested fall, and enables the fall victim to escape from remaining suspended in the safety harness. Such a suspended condition, if prolonged for as long as 15 to 30 minutes can result in suspension trauma, a deadly series of events which occur in sequence after an arrested fall, wherein the blood flow to and from the lower extremities is interrupted by the leg straps of the safety harness, leading eventually to unconsciousness and death from circulatory insufficiency.

As illustrated in FIG. 1, in a preferred embodiment the emergency descender 1 comprises a housing 1A, which housing in turn comprises a front half 2 and a rear half 3. The housing 1A incorporates a support and mounting system 4, which serves to connect one end of the housing to a stationary pole, platform, tree, or other structure by an anchor strap 6, while at the other end of the housing a terminal end 7 of a stored quantity of descent line protrudes through an opening sealed by a grommet 16. In the embodiment shown by FIG. 1, the support and mounting system 4 comprises a pair of structural supporting plates 10, one each located on the front and back sides of the housing, which plates are connected to internal load-bearing components of the descender by fasteners 11, which fasteners can be high-strength bolts, screws, rivets, pins, or similar fasteners. Attached to the top of such supporting plates 10, front and back, are a pair of straps 15, configured as a spaced-apart yoke assembly, which yoke straps 15 are attached to such plates 10 on the front and on the back, in the example shown by a sewn loop 12. Likewise, at an opposite end of the descender, the yoke straps 15 wrap around the end-corners of the descender, are joined together in upper section 5, and continue to form a terminal end, in this case comprising a loop 14 which is attached to anchor strap 6. The yoke straps may be made of webbing material, or of metal, or of another durable thermoplastic or other composite material, and may be made integral with the plates 10.

Referring to FIG. 2, it will be seen that the anchor strap 6, which is attached to the tree, pole, or other structure 6B, is further attached with a connector 6A, which connector 6A may comprise a buckle, ratchet-strap connector, seat-belt-type connector, or other connector, to provide for both securing the anchor strap 6 to the tree, pole, or other structure 6B, as well as for adjusting the length of such anchor strap 6 when it is attached to a tree, pole, or other structure 6B. In the embodiment shown, the terminal end of the descent line 7 is attached to an end loop 9C of a shock absorbing tether 9 of a safety harness via a carabiner 8. Any type of anchor strap, including a simple length of rope with a loop in each end, may be used for attachment of the descender unit or the tether of a safety harness incorporating the descender.

Figure 3:
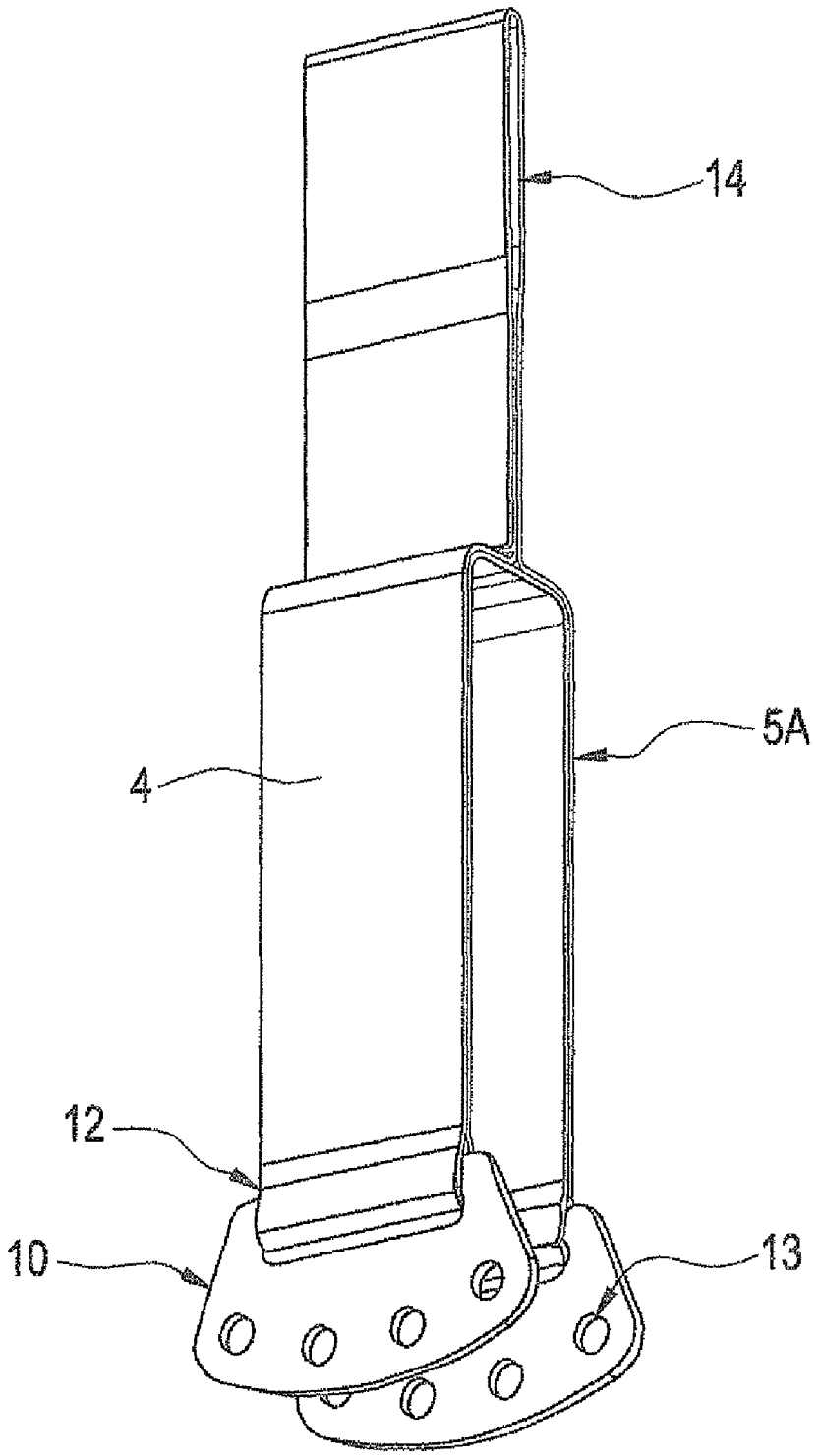
FIG. 3 is a perspective view showing the yoke-shaped support straps and the rigid support plates which comprise two of the main elements of the improved support and mounting system of the invention.

FIG. 3 shows an embodiment of the improved support and mounting system 4, comprising a pair of support plates 10, webbing strap members 5A, and webbing end-loop 14. In addition, the upper loop 14 which is attached to the anchor strap 6 is also shown. Support plates 10 also show the holes 13, through which the fasteners 11 attach the plates to the internal components.

Figure 3A:
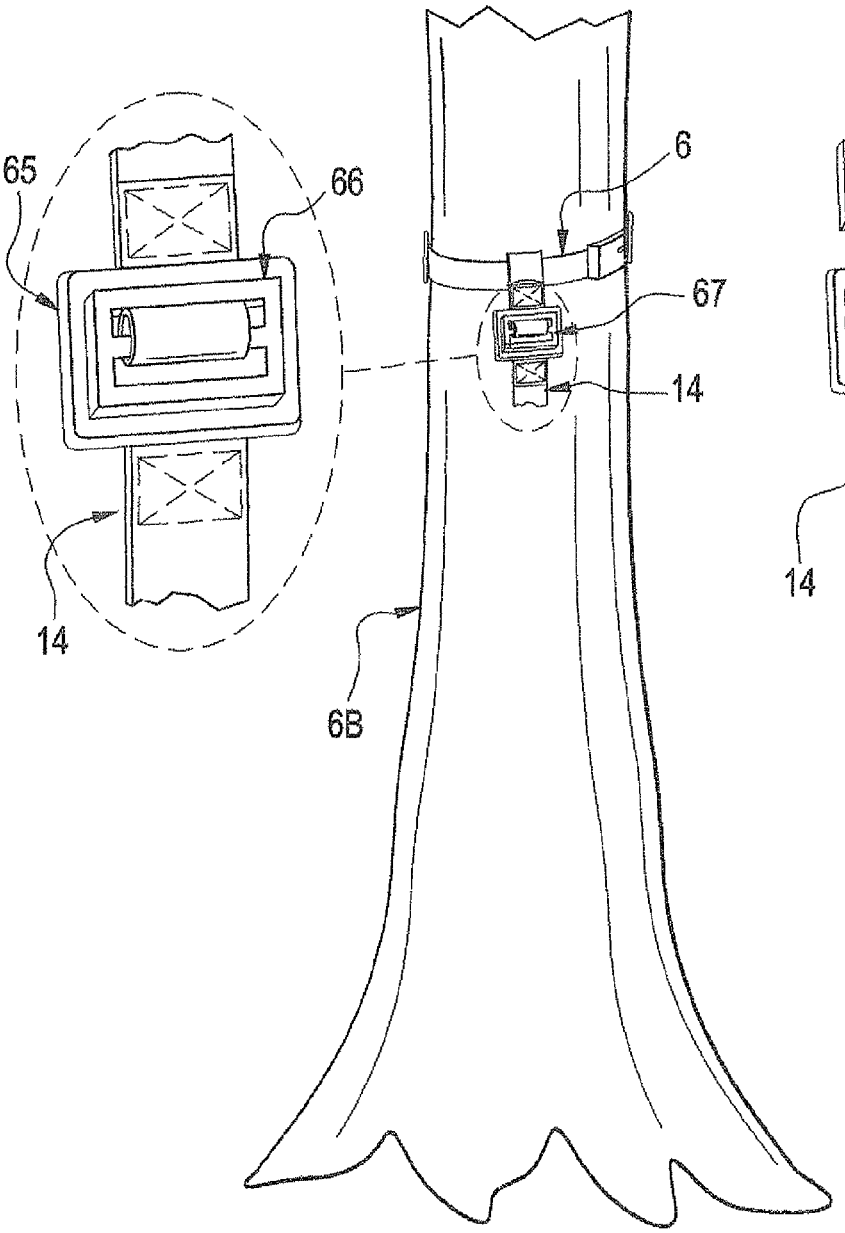
FIGS. 3A and 3B shows a quick connect buckle to facilitate attachment of a strap from the descender to a tree or other support.
Figure 3B:
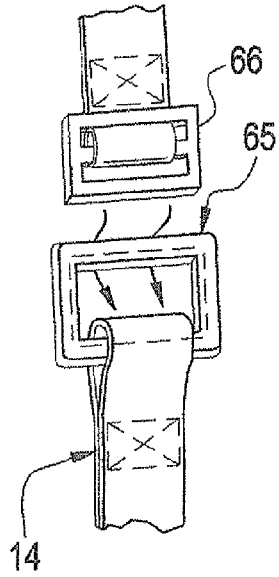

FIG. 3A shows an embodiment of the improved support and mounting system wherein upper loop 14 is attached to one half of a mating, interlocking, quick-connect buckle 65, and which buckle half 65 is joined to a mating half 66 of such quick-connect, interlocking buckle, comprising a buckle assembly 67, to permit quick attachment and detachment of the descender 1 to or from a tree-strap or anchor strap 6 so that the descender unit 1 can be quickly attached to or detached from the tree strap or anchor strap 6, which tree strap or anchor strap can remain attached to the tree or other elevated structure 6B after removal of the descender 1.

Figure 4:
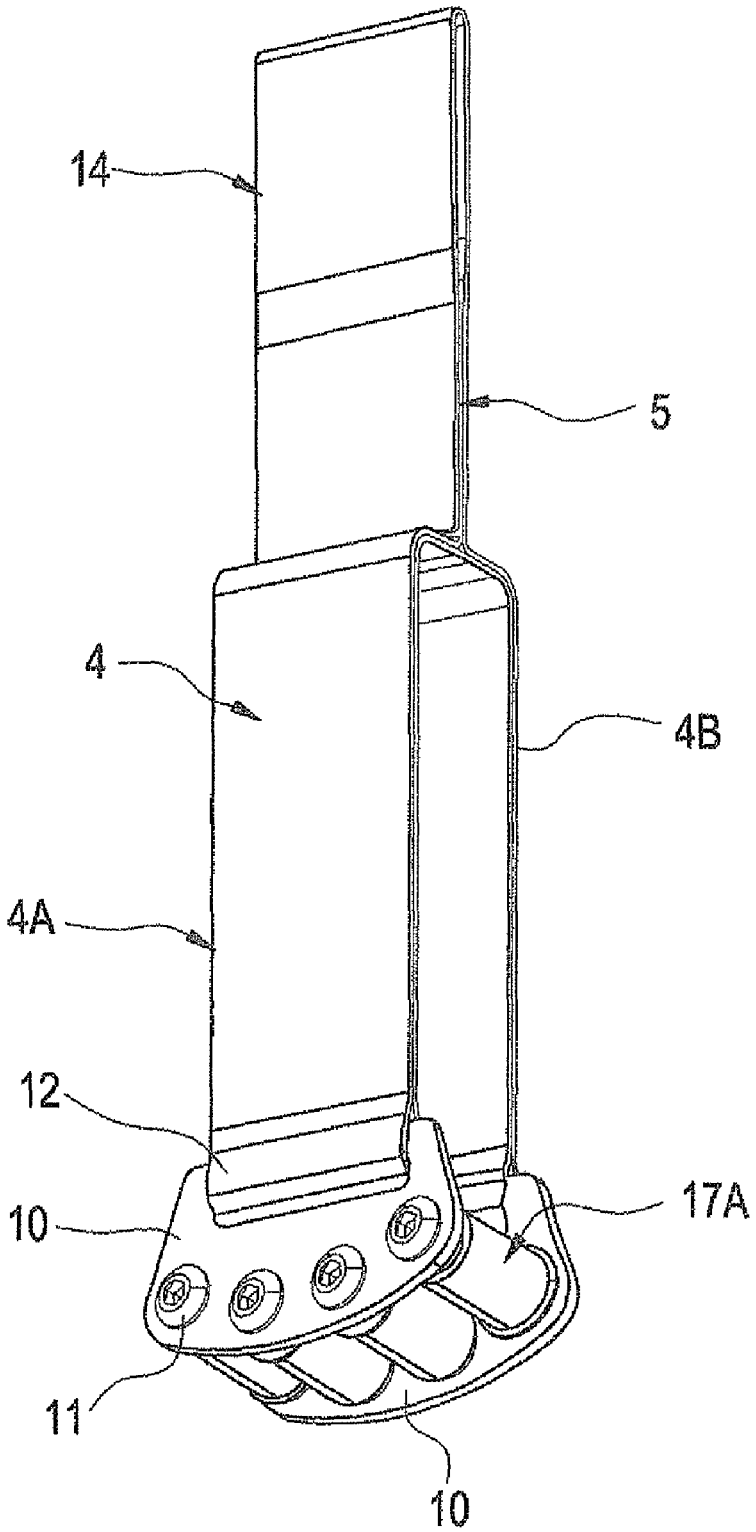
FIG. 4 is a perspective view showing the yoke-shaped support straps and the rigid support plates which comprise two of the main elements of the improved support and mounting system of the invention, and also showing the third and fourth main elements of such improved support and mounting system, namely the large weight-bearing friction bars, and fasteners utilize to attach such friction bars through the enclosure and to the rigid support plates.

In FIG. 4, the improved support and mounting system 4 is again shown in an isolated, perspective view, with the array of load-bearing frictional braking bars 17 shown attached to the plates 10 by fasteners 11.

Figure 5:
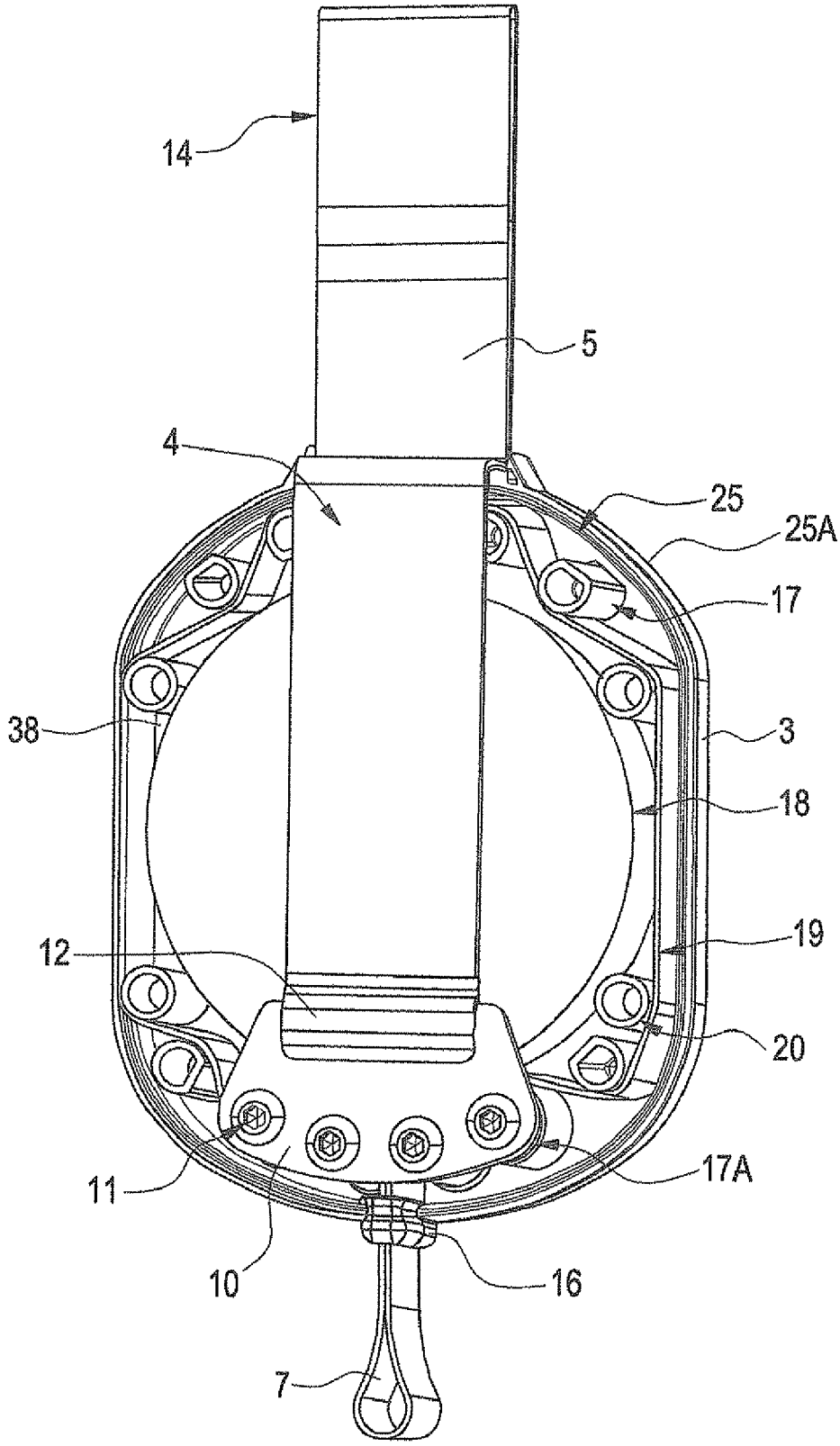
FIG. 5 is a perspective view showing a preferred embodiment of the invention, as in FIG. 1, except with the front enclosure section removed, to reveal the interaction of the improved support and mounting system with the enclosure and with the internal braking mechanism components.

FIG. 5 illustrates a preferred embodiment of the descender system 1, with the front housing half 2 removed, revealing the internal components as they are attached to the inner back wall 38 of rear housing half 3. The relationship of the improved support and mounting system 4 to the array of load-bearing friction bars 17A are revealed, as are the stored coil of webbing 18, tubular friction-inducing members 17, and standoff-guide members 20, as well as a groove 25 which houses the O-ring 25A which seals the juncture of the two enclosure halves 2 and 3 against water intrusion.

Figure 6:
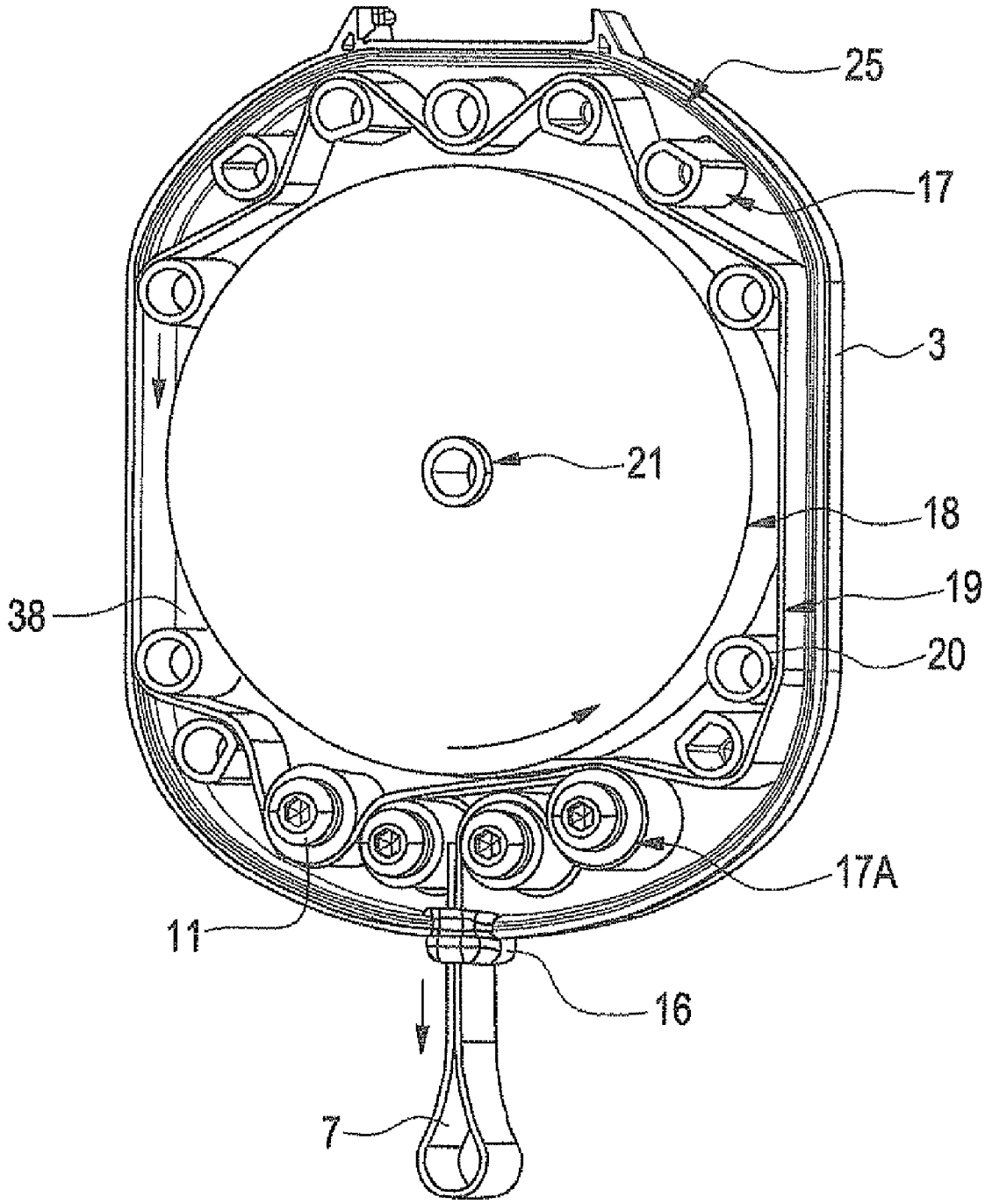
FIG. 6 is a perspective view of a preferred embodiment of the invention with the front enclosure section, the supporting plates, and the supporting yoke assembly removed, to show the interaction of the descent webbing and other internal components of the braking mechanism with the housing and with the large, weight-bearing friction inducing bars, as well as with the grommet seal.

In FIG. 6, the geometry and operation of the descender is revealed, with all internal components shown as attached to the interior planar wall 38 of the rear housing half 3. Beginning at the central stationary hub 21, the stored descent line is arranged in a coil 18, which is wound upon itself in a spiral configuration, until sufficient quantity of line is in place. Generally, this quantity can range from about 15 feet to as much as 100 feet of line, or more. The line 19 then proceeds through the array of tubular friction-inducing members 17 and the standoff-spacers 20, and in a preferred embodiment, in a serpentine or alternating path, such that an appropriate amount of frictional force is induced upon the line 19 to resist the payout of the line against the weight of the user, and to provide such user with a controlled-rate descent at a safe velocity, generally ranging from about 0.25 feet per second up to about 4.0 feet per second. In the embodiment shown in FIG. 6, the webbing 19 winds among the array of stationary, friction-inducing members 17 and spacer-standoffs 20, around the periphery of the stored coil of webbing 18, and then in a particular path, as shown, around and among the array of larger, load-bearing friction bars 17A, in such a way that the impact load of a fall, as well as the principal weight of the descending user are borne by the friction bars 17A, which transfer such weight loads to the support plates 10, as seen in FIG. 5, and thence through the webbing members of the improved support and mounting system to the anchor strap 6 mounted to the tree, pole, or other platform 6B.

The emergency descender 1 includes means for preventing rotation of the friction-inducing members 17, including configurations of such friction inducing members 17 having flat surfaces 43 along one longitudinal side, which flat surfaces 43 engage with mating recesses 44 in the supporting walls of the two enclosure halves 2 and 3. By preventing such rotation, the descent line 19 is forced to slide against the stationary surfaces of friction inducing members 17, as opposed to moving over a rotating surface which would not generate the desired friction. Likewise, the load-bearing friction bars 17A are firmly and securely attached to the supporting plates 10 in such a way that such friction bars 17A cannot rotate, in order that sliding friction of the descent line 19 against the bars 17A is maintained. In the case of machine screws used as fasteners 11, using two such fasteners 11 to mount each such bar 17A, with one each such fastener 11 threaded into each end of each bar 17 enables an anti-rotation capability which arises from the opposing resistance to torque on the two sides of each bar 17A, which opposing resistance counteracts any tendency for such bars 17A to rotate in either rotational direction.

Figure 7:
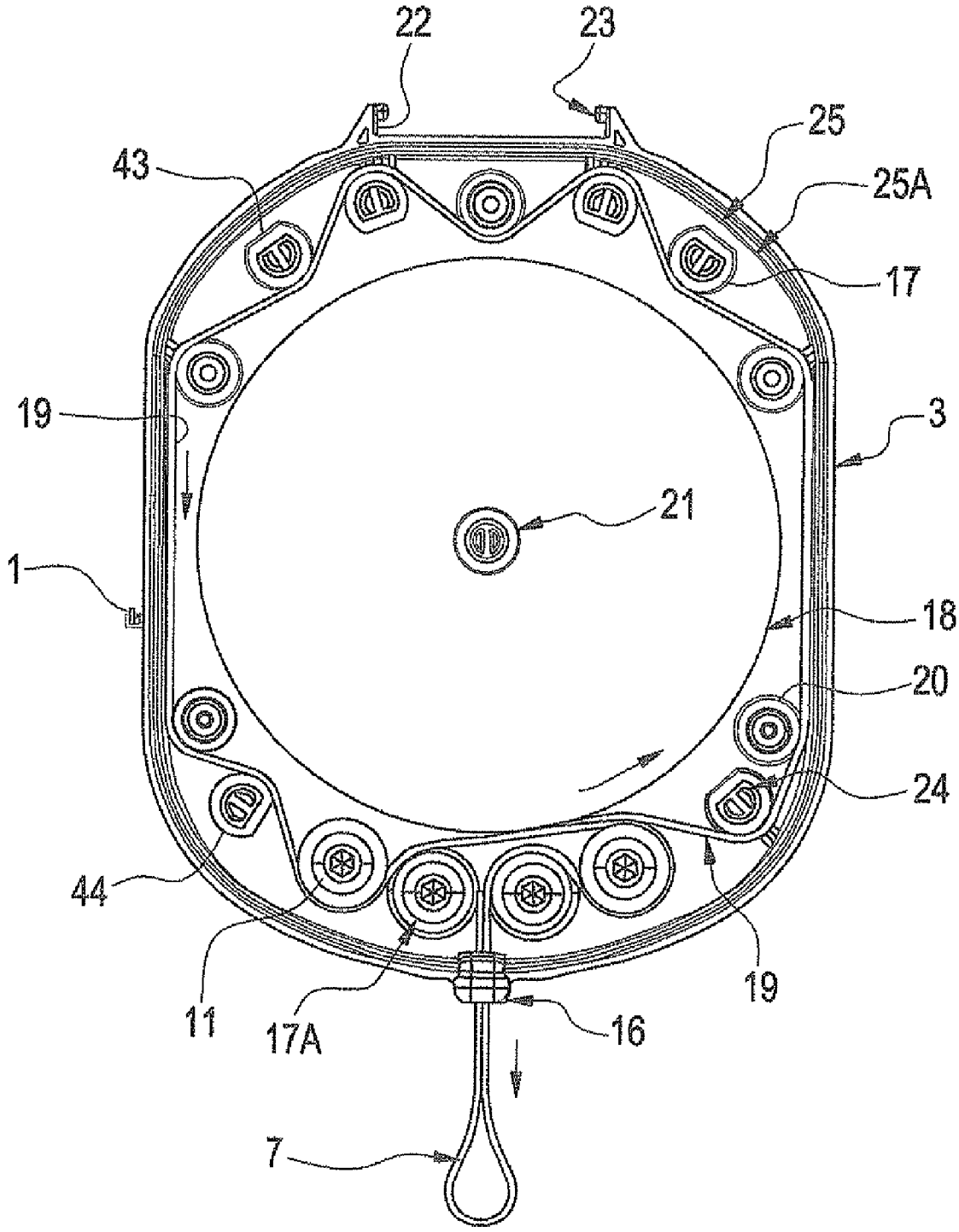
FIGS. 7 and 7A are a frontal plane view of a preferred embodiment of the invention with the front enclosure section, the supporting plates, and the supporting yoke assembly removed, to show the interaction of the descent webbing and other internal components of the braking mechanism with the housing and with the large, weight-bearing friction inducing bars, as well as with the grommet seal. In addition, FIG. 7 reveals the area at the top of the enclosure where the yoke assembly of the improved support and mounting system passes under the guiding nibs on both the front and rear halves of the enclosure, to guide the support members of the yoke assembly outward at the centerline juncture of the front and back halves of the enclosure.

FIG. 7 illustrates another view of a preferred embodiment of the emergency descender 1, with front enclosure half 2 and improved support and mounting system removed to reveal the internal components of the descender 1, as housed within the rear housing half 3, and the braking system comprising friction-inducing members 24 positioned in a geometric array around the periphery of stored line coil 18, spacer-standoffs 20, and load-bearing friction bars 17A. The path of the descent line 19, as it winds among the braking system elements of friction-inducing members 24, standoff-spacers 20, and load-bearing friction bars 17A, as configured in a preferred embodiment, are clearly shown, along with the terminal end 7 of the coil of descent line 18. Also shown is the area 22 at one end of the descender 1 where the two yoke halves 4A and 4B come together and are joined in upper section 5. Nibs 23 are shown, which retain the improved support system upper yoke halves firmly against the outer wall of the enclosure halves 2 and 3 of the descender 1.

Figure 7A:
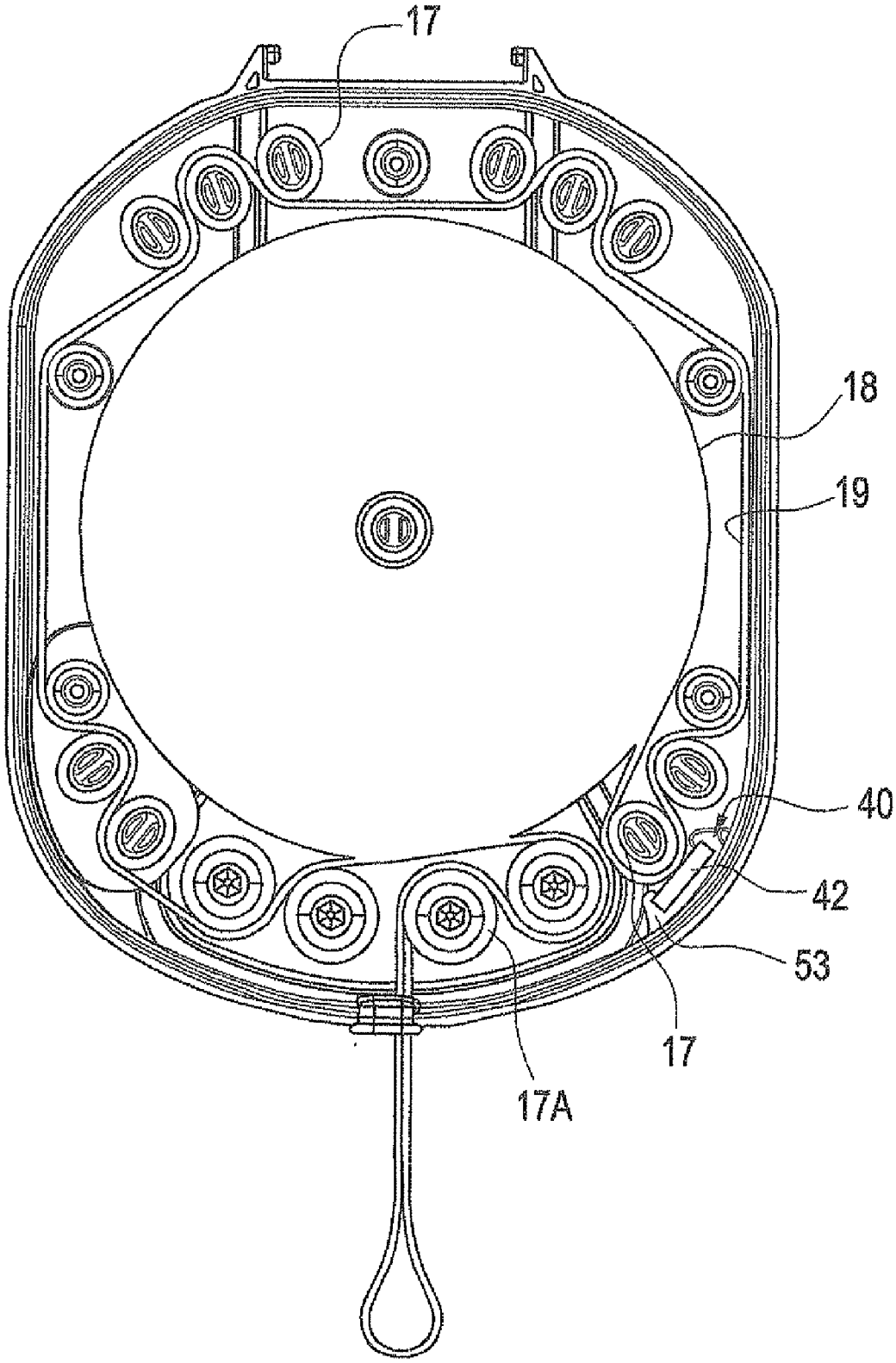

FIG. 7A illustrates the components as revealed in FIG. 7, in another preferred embodiment wherein a supplemental braking system 40 is employed, which supplemental braking system comprises a mounting bracket 53 for a braking pad 42. In the event that one or another webbing path configuration provides insufficient braking to ensure a safe, controlled descent for a person, at a slow enough speed for comfort, this supplemental braking system may be employed, which utilizes a pad 42 of preferably resilient and temperature-resistant material, which is pressed and held against the webbing 19 by the configuration of the bracket 53. Positioning of the supplemental braking system adjacent the first friction-inducing member 17 produces the greatest mechanical advantage, and hence, produces the highest frictional force, as compared to positioning at other locations adjacent other friction-inducing members 17 around the periphery of the coil of descent line 18, which locations closer to the exit point of the line 19 from the descender 1 result in progressively lower mechanical advantage, and therefore impart less friction at such locations to the descent line 18.

Figure 8:
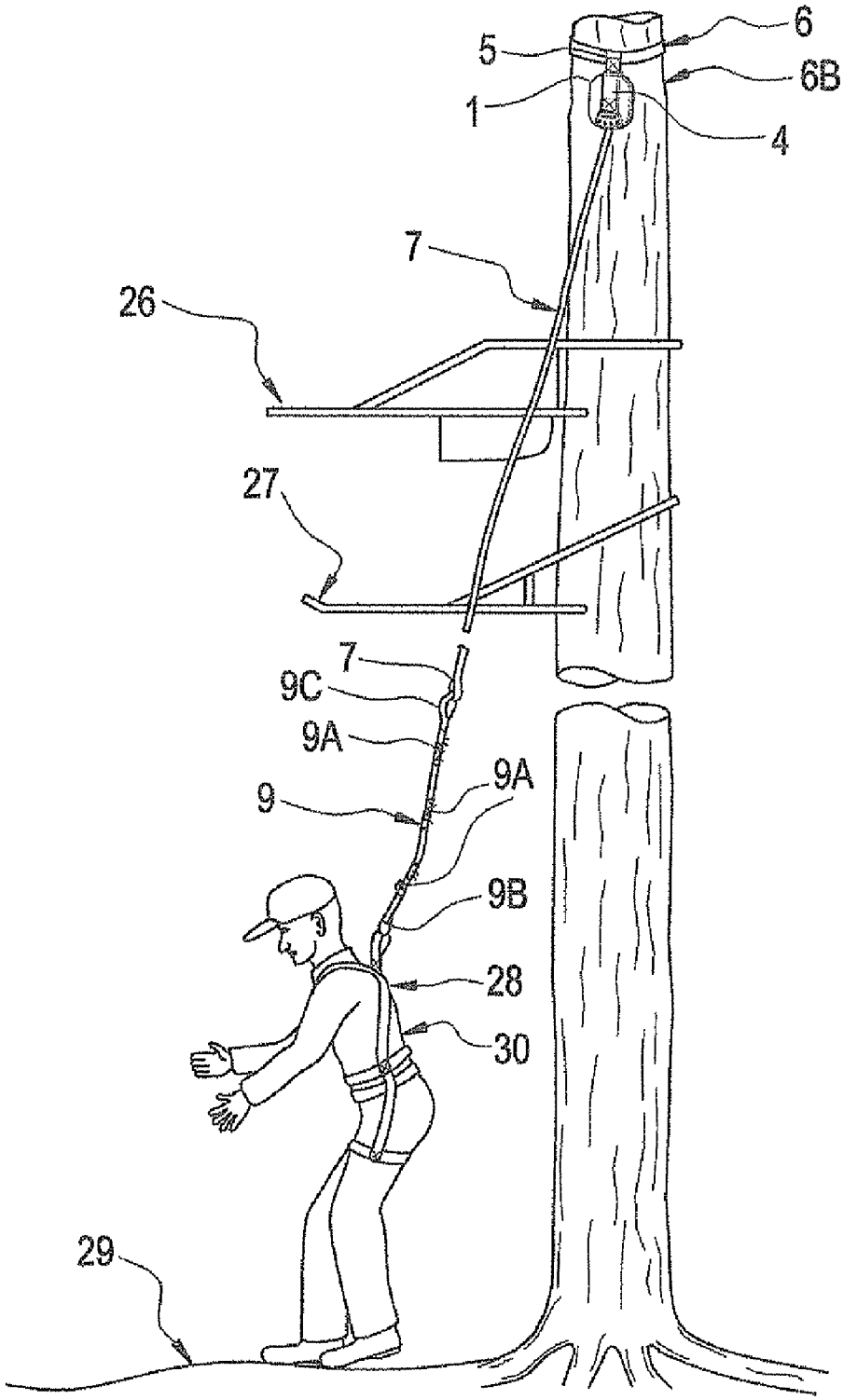
FIG. 8 is a perspective view of a hunter who, having experienced a fall from a climbing treestand, was saved from experiencing suspension trauma which could have resulted from prolonged suspension in the fall-arresting safety harness by the descender module of the invention. Upon experiencing the fall, the weight of the hunter caused the descent line to be pulled from the descender module at a safe rate which was controlled by the braking mechanism inside the enclosure of the descender module. The descender module of the invention, in a preferred embodiment, is shown attached to the tree, and supported by the improved support and mounting system of the invention.

FIG. 8 illustrates the use of the emergency descender 1 by a hunter 30 who has fallen from a treestand 26 which also included a lower platform 27. As shown, the emergency descender 1, in the embodiment illustrated, is equipped with an anchor strap 6 which is used to attach the emergency descender 1 to a tree 6B. The emergency descender as shown incorporates an improved support and mounting system 4, which connects the emergency descender 1 to the tree strap 6 via upper yoke section 5. When the hunter sustained the fall, the first occurrence was for the slack to be taken out of the shock absorbing tether 9 attached to the safety harness 28, as a result of the fall impact against the limits of the full length of the tether 9. Next, as shock loads from the fall peaked, such shock loads were mitigated and absorbed by activation of the tear-away sections 9A in the shock-absorbing tether 9. Upon deployment and activation of the tear-away shock absorbing sections 9A, the weight of the hunter caused the descent line 7 to be pulled gradually from the emergency descender 1, supporting the weight of the hunter 30 as he descended gradually and safely from his fallen and suspended position. Eventually, the hunter descended to the point where his feet reached the ground 29, enabling him to quickly recover from his experience, without having suffered the onset of painful and deadly suspension trauma.

Figure 9:
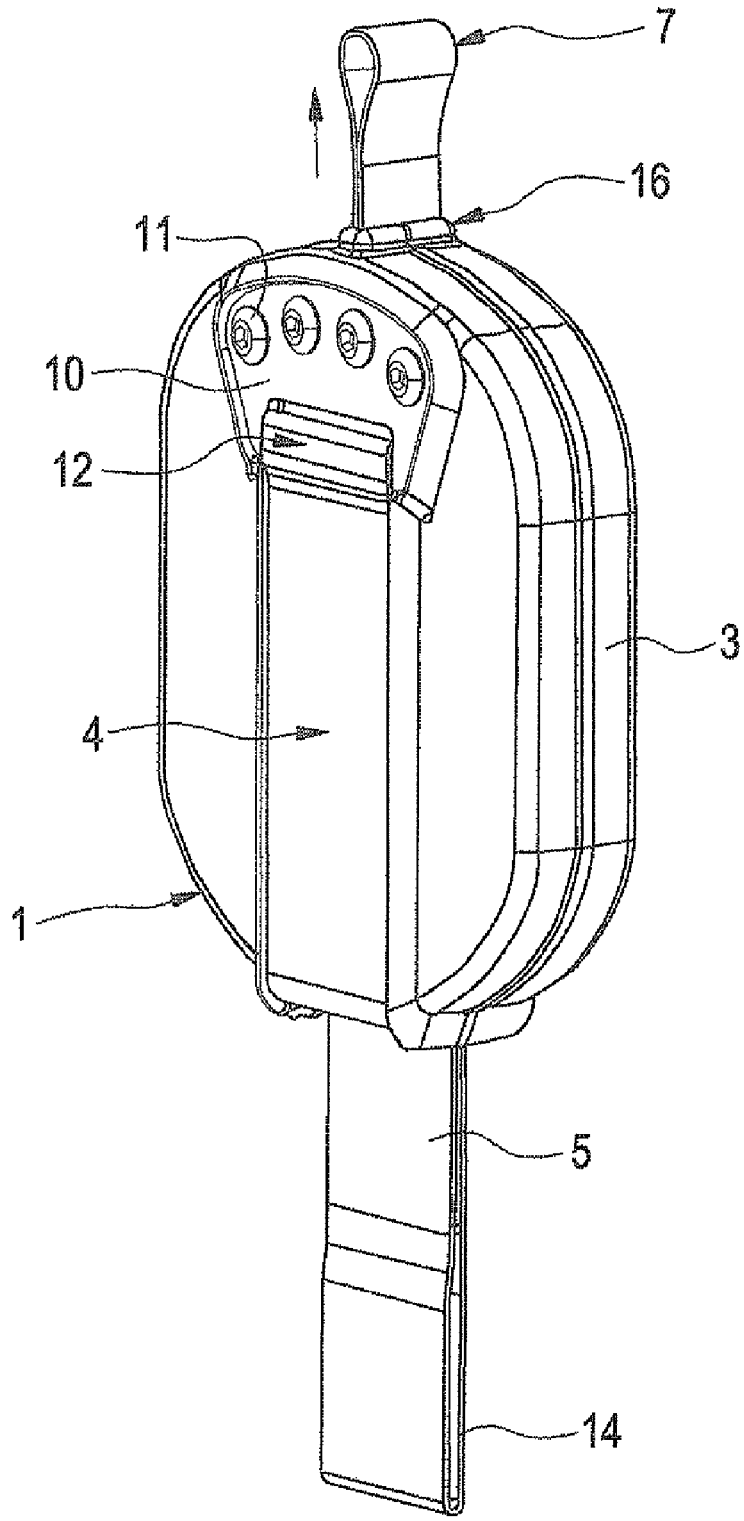
FIG. 9 is a perspective view of another preferred embodiment of the invention, wherein the descender module is inverted such that the anchor strap of the improved support and mounting system is located below the descender module, such that the descent line can exit upward out of the device in the event that a user experiences an arrested fall when the descender module is attached to the user's fall-arresting safety harness using the anchor strap of the improved support and mounting system.

FIG. 9 illustrates another preferred embodiment of the invention, wherein the emergency descender 1 is inverted, to allow attachment of the device to a safety harness worn by the user. As will be obvious from this and subsequent illustrations, the loop 14 in this embodiment becomes, instead of an anchor-attachment means to a fixed structure, a means of attaching the emergency descender 1 to the waist and leg straps of a fall-arresting safety harness or safety belt. The improved support and mounting system 4 is shown, as well as the terminal end 7 of the descent line, which line would be extracted upward and outward from the enclosure 1A of the emergency descender, as the emergency descender travels downward with the user during the descent.

In a preferred embodiment, the descent line 7 can be made from a variety of high-strength woven synthetic polymer webbing materials, such as nylon, polyester, Kevlar, Spectra, and others. Also in preferred embodiments, the emergency descender 1 can be configured to store about 25 feet of descent line 7, or webbing, to enable a typical hunter 30 who is at least 5 feet tall to descend safely from a hunting elevation of up to 30 feet, which is the practical limit of height for most hunters. In commercial or industrial environments, where larger housings 1A of the emergency descender 1 might be tolerated, the emergency descender 1 could be configured to contain greater lengths of descent line, up to 100 feet or more, depending upon the thickness and related strength requirements of the descent line 7.

Figure 10:
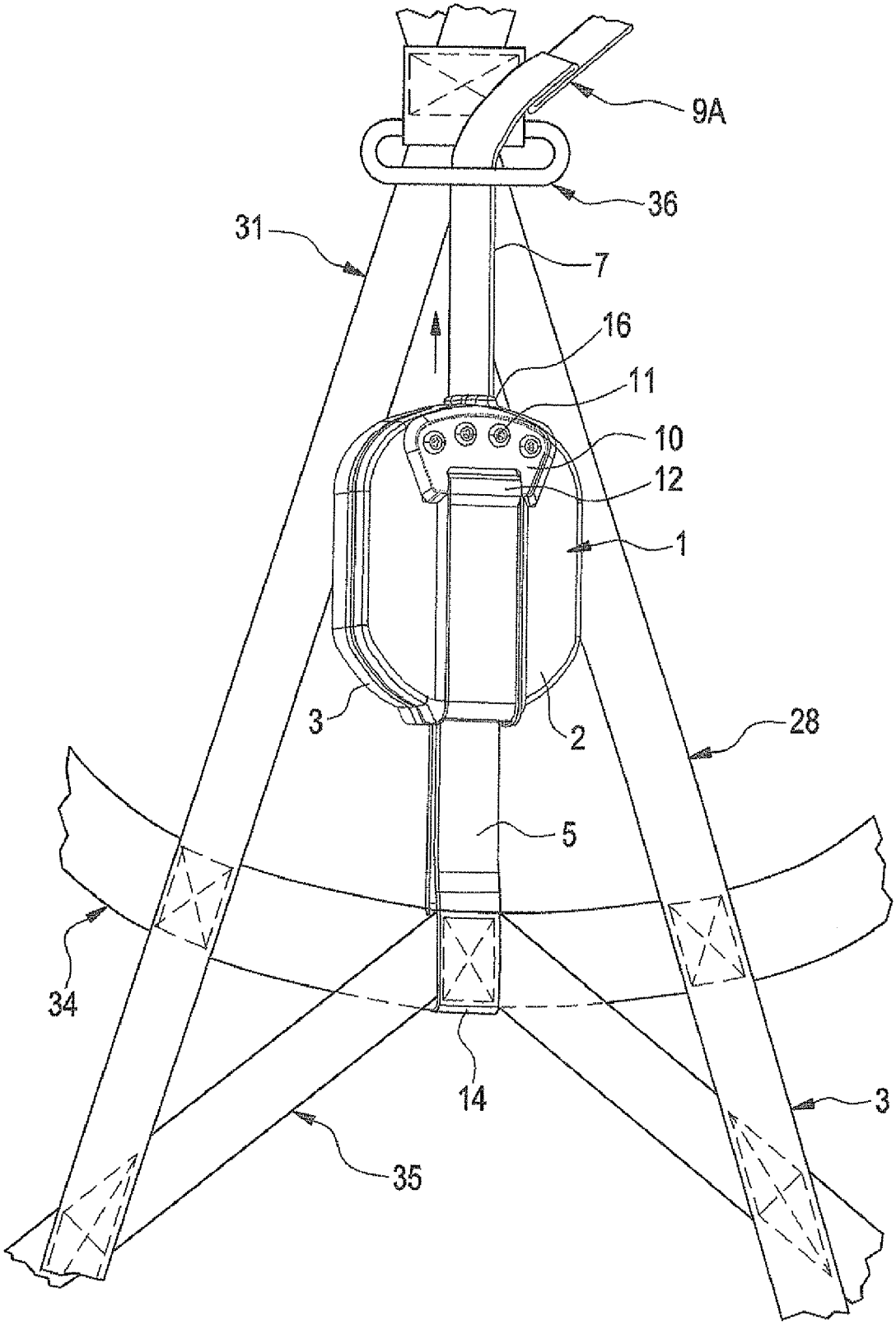
FIG. 10 is a perspective view of a preferred embodiment of the invention, inverted as shown in FIG. 9, and attached to both the waist belt and the leg straps of a fall-arresting safety harness. The descent line is pulled up and out of the enclosure in the event that an arrested fall is experienced by a user, with the weight of the user forcing the user to descend at a controlled rate, which rate is controlled by the internal braking system of the descender module.

As illustrated in FIG. 10, the emergency descender 1, in a preferred embodiment as shown, can be attached to, or built into a fall-arresting safety harness 28, so that the self-rescue and safe descent protection provided by the emergency descender 1 is continually in place whenever a worker is engaged in activities at heights, or a hunter 30 is hunting from an elevated platform such as a treestand 26. Such configuration also eliminates the need for a user to carry the emergency descender 1 as a separate item, and the need to mount it separately to a tree, pole, or other structure 6B. As illustrated in the preferred embodiment shown, the device is attached to both the waist belt 34 and the leg-strap-connector 35, by a sewn attachment at loop 14. The improved support and mounting system 4 is shown, providing a connection between the harness 28, the emergency descender 1, and the descent line 7. The descent line 7 as shown merges into the shock-absorbing tether 9, with shock-absorbing tear-away strips 9A, which then terminates in a carabiner 8 which is attached to an anchor strap 6, utilizing a buckle connector 6A. An oval ring 36 is shown, sewn into the juncture of where the two shoulder straps 31 meet. The descent line 7 passes through this ring 36, or an equivalent structure so that in case of a fall the weight of the wearer of the harness 28 will be supported high up on the wearer's back, between the shoulder blades, as required by Treestand Manufacturers Association specifications, ANSI, and other specifications.

In the event of a fall, in the preferred embodiment illustrated in FIG. 10, the emergency descender 1 will remain with the user, who is wearing the fall-arresting safety harness 28, while the descent line 19 will be pulled from the stored coil of descent line 18 within the emergency descender 1, as the user of the device descends at a gradual rate. The terminal end of the descent line 7 and shock-absorbing tether are anchored to an upper location on the tree, pole, or other stationary platform.

FIG. 10A-F illustrates another preferred embodiment of the invention, showing a different configuration of the braking unit 100 and the stored webbing 18, in combination with a safety harness 28, wherein the braking unit 100 comprises a vertical, elongated assembly, which further comprises two elongated braking bars 39 each having an inner surface 40, which braking bars 39 are mounted together in such a way that such surfaces 40 face and mirror one another, and are mounted to maintain a defined, fixed space 41 between such surfaces 40. Such inner surfaces comprise a series of alternating convex lobes and convex recesses, such that the space 41 which is maintained between such inner surfaces 40 defines a serpentine path from a first end 58 of each of the braking bars 39 to a second end 430 of the braking bars 39. Such braking bars 39 are joined together by and attached to a pair of side bars 63, to comprise the braking unit 100, which further comprises means 69 for attaching a first end 58 of the unit 100 to the waist belt 34 of a safety harness, and means 70 for attaching a second end 430 of the braking unit 100 to the shoulder straps 31 of the safety harness 28 at a point above the waist belt 34, and approximately at a point roughly between the shoulder straps 31 of the safety harness 28. The stored descent line 18 is housed in a rigid or semi-rigid container 47, which is attached to the waist belt 34 of the safety harness 28, and is equipped with an enlarged retainer 48 attached at the lower end of the stored descent line 18. A portion of the descent line 7 passes through an upper opening 49 in the container 47 extends upward between the two mating surfaces 40 of the braking unit 100, where such line 7 then emerges from the upper end 43 of the braking unit 100, and then extends upward through guiding means 50 which holds such descent webbing adjacent to the upper portion of the back of the safety harness 28, where such webbing then emerges from inside the safety harness 28, and either forms, or is attached to, a shock absorbing tether 9 having a loop at its upper end, for attachment to a tree or other elevated platform. The braking unit 100, including the line storage container 47, mounting means 53 and 54 are designed to afford as flat a profile as possible, and to be relatively concealed and cushioned by adjacent padding elements 55, positioned between the outer rear panel 51 of the safety harness 28 and the inner rear panel 52 of the safety harness 28, to maintain the comfort of the wearer. The line storage container 47 comprises a first section 56 and a mating second section 57, which sections are joined in such a way as to resist the entry of water, and to protect the line 18 from degradation and deterioration as a result of environmental factors. The container is configured to permit free and un-impeded passage of the descent line 7, 18 to the braking unit 100. It is preferably made of a rigid or semi-rigid material in order to protect the descent line against being squeezed or mashed, to ensure that the passage of the descent line 7 into the braking unit 100 is not impeded.

Figure 10A:
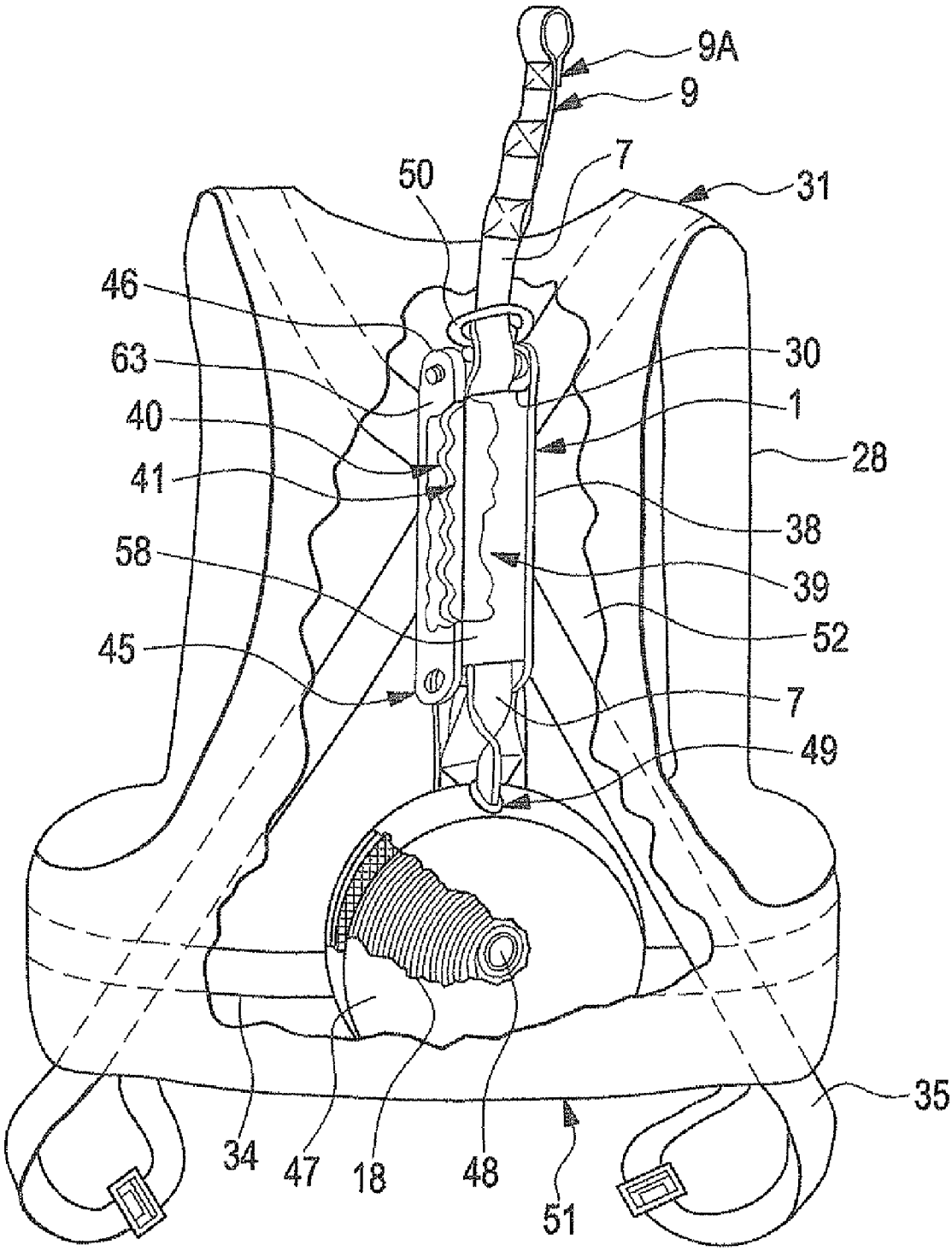
FIGS. 10A-10I show other embodiments of the invention that entails a braking unit and separate container for housing the descent line. Various embodiments of the braking unit are disclosed as are alternative uses thereof.
Figure 10B:
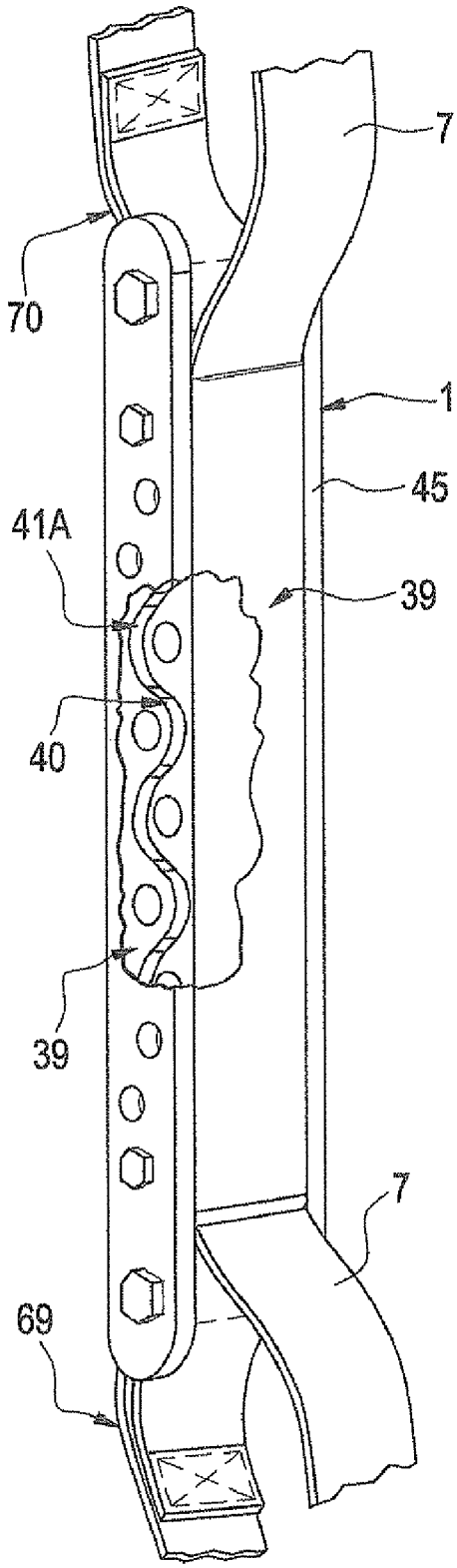

FIG. 10B illustrates the braking unit assembly 100, including the two elongated rectangular braking bars 39 having internal matching, mirror-image friction-inducing surfaces 40, uniformly spaced apart to comprise a convoluted pathway 41A through which the descent line 7 is pulled during a descent, to provide a controlled, safe, relatively slow rate of descent for a wearer of the safety harness 28 who experiences a fall. Also shown are the two side bars 45 which join and attach to the braking bars 39. Also shown are the mounting means 69 and 70 for attachment of the braking unit to the safety harness 28.

Figure 10C:
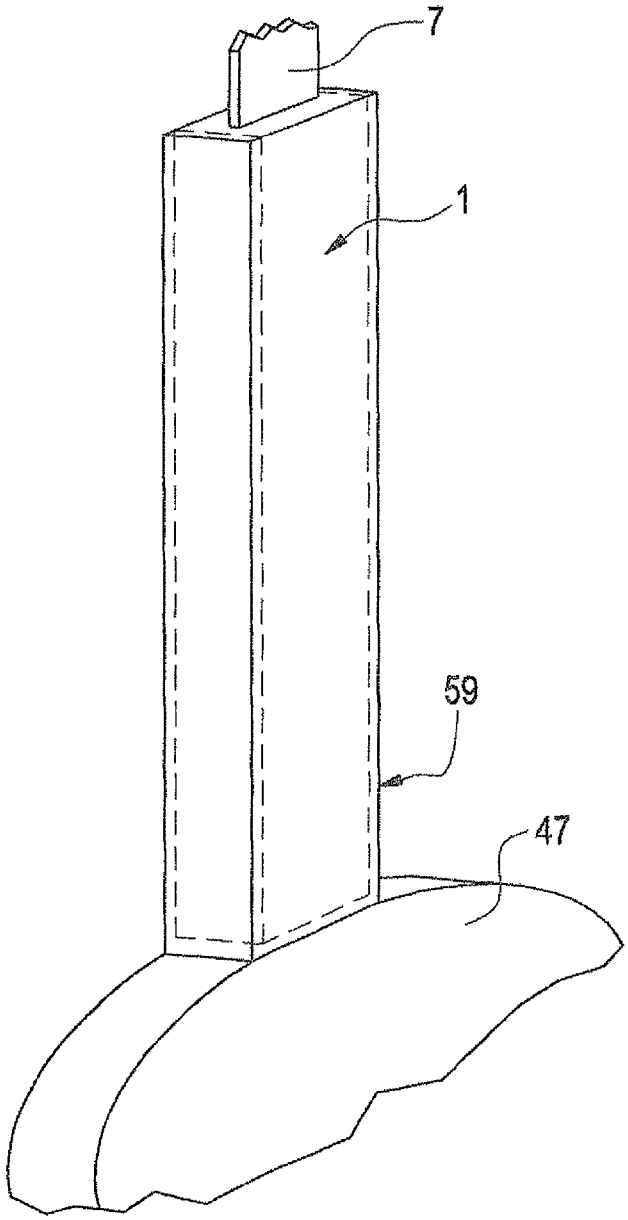

FIG. 10C illustrates a cover 59 for the braking unit 100, which is provided to protect the braking unit 100 and the descent line 7 within the braking unit 100 and the descent line container 47 from the effects of rain and other environmental factors.

Figure 10D:
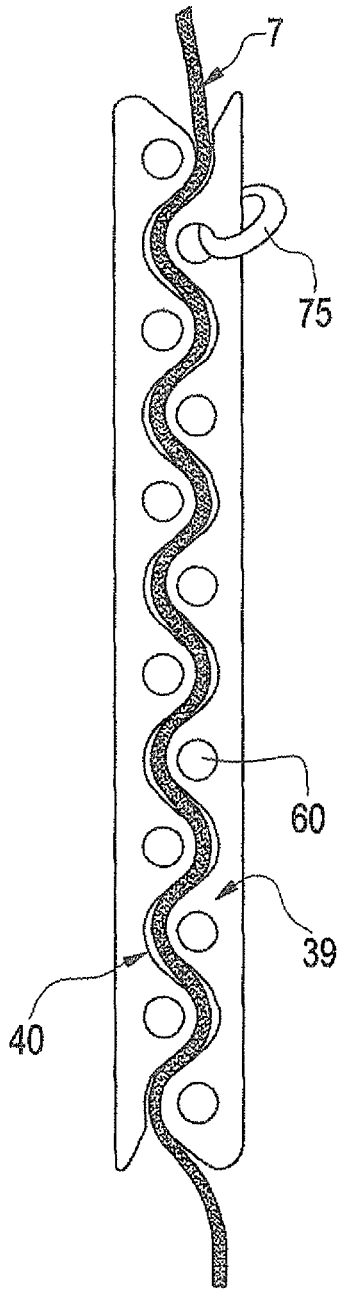

FIG. 10D shows a side view of a preferred embodiment of the two braking bars 39, wherein the braking bars 39 are comprised of a machined, cast, molded, or extruded material, the profile of which braking bars 39 include a plurality of openings 60 therethrough, which openings 60 serve to reduce weight and to reduce thermal mass, in order to more quickly and effectively dissipate heat generated by friction of the descent line 7 as it rubs against the friction inducing surfaces 40 of the friction bars 39 during a descent.

Figure 10E:
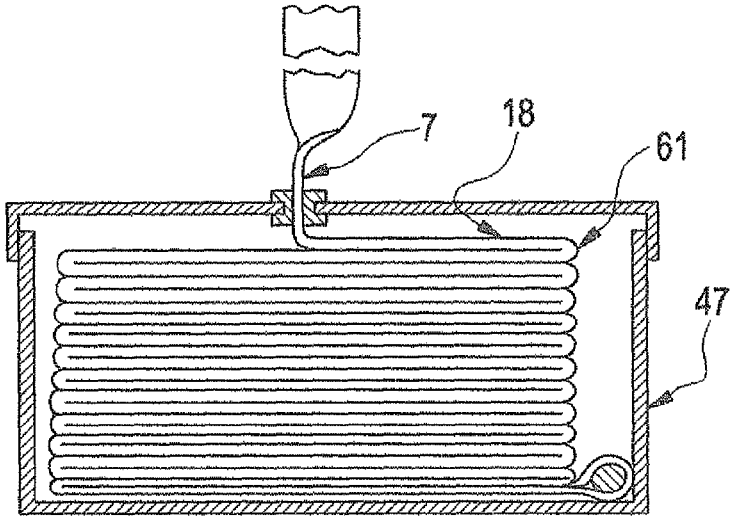

FIG. 10E illustrates a cross-section rear view of a descent line container 47 configured to store the stored descent line 18 in back-and-forth folds 61 within the container 47, rather than in a circular coil.

Figure 10F:
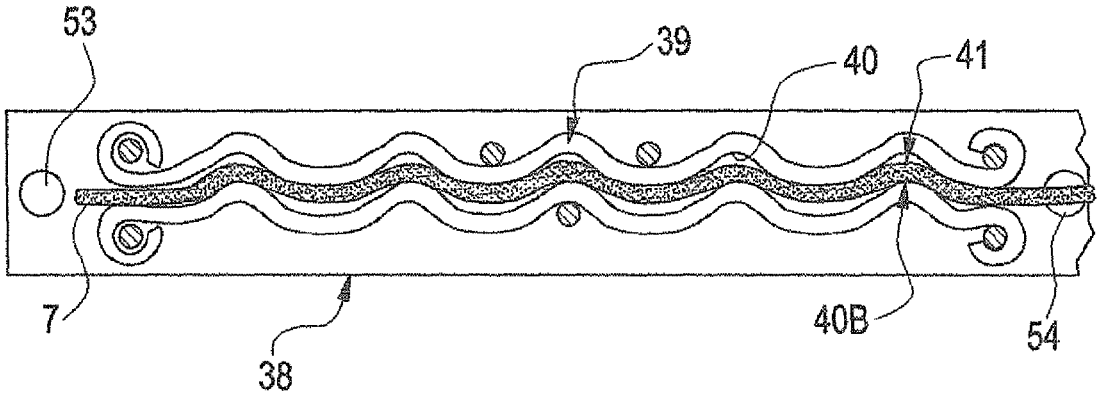

FIG. 10F illustrates a side view of a pair of another preferred embodiment of the elongated braking bars having mating, spaced apart, convoluted surfaces 40, where such bars are formed from fabricated or stamped material such as aluminum, and held together by a pair of side bars 45, and between which internal, facing surfaces of such bars a length of descent webbing 7 passes, in the space 41 between such bars 39, such that the friction induced by the male lobes 40B of the braking bars 39 is sufficient to control the rate of descent of a user of such system in a safety harness 28, in the event such wearer experiences a fall from an elevated location.

Figure 11:
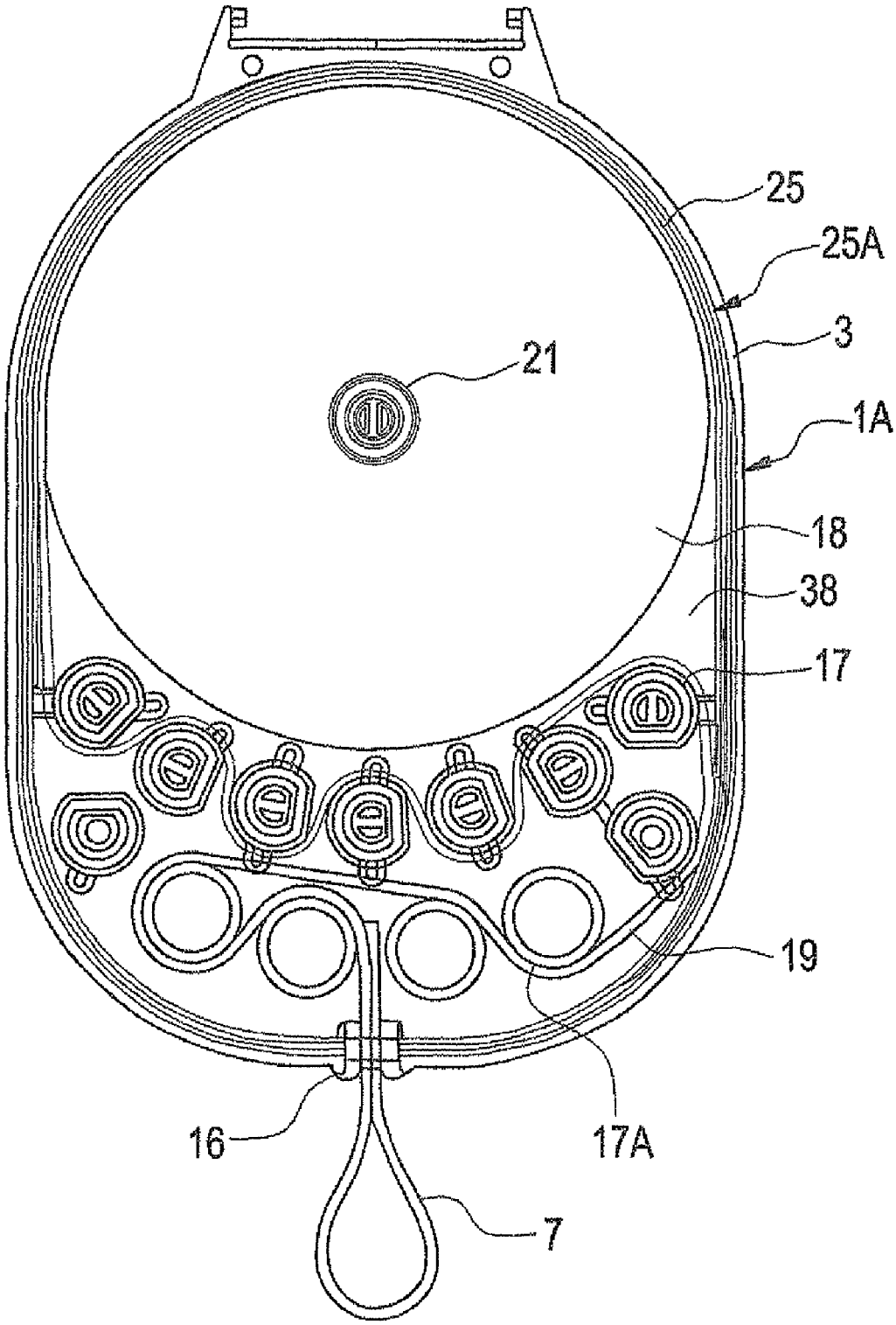
FIG. 11 is a planar frontal view of the inside of the descender module, with the front half of the enclosure removed to reveal the braking mechanism components inside. Said components consist of an array of moats and tubular friction-inducing members, positioned upon a series of bosses protruding from the inner wall of the enclosure halves, and provided with additional strength and support by walls of the recessed moats. In addition, a second array of load-bearing- and friction-inducing members is shown, which members absorb the impact load of a fall at the beginning of a descent, and transfer such loads to the metal plates on the outside of the enclosure and thence to the webbing yoke members, which are connected at the end of the enclosure, and attached to an anchor point or to a mounting attachment means inside a safety harness. The relationship of the stored coil of descent line, the interior walls of the housing, and the simplified positioning of the array of friction-inducing members are also revealed, as is the central boss which serves as an axle located within the enclosure and is centered upon the main coil.

FIG. 11 illustrates a preferred embodiment of the invention comprising a smaller housing 1A for the emergency descender 1, a coil of stored descent line 18 positioned adjacent one end of the interior space in housing 1A, an array of stationary friction-inducing members 17 and load-bearing friction bars 17A positioned between the coil of stored descent line 18 and the end of the enclosure where the terminal end 7 of the descent line 19 exits the box through grommet opening 16A and grommet 16. The more compact geometry and layout of this embodiment permits a wide range of possible paths for the descent line 19 to be wound around and among the friction inducing members 17 and load-bearing friction bars 17A. As in the embodiments shown in FIGS. 1, 2, and 8, the emergency descender can be used as a stand-alone emergency descent device, or inverted and used as an emergency descent device attached to or integrated into a design for a safety harness 28 as in FIGS. 10, 13, 14, and 15. The compact size facilitates such integration of the emergency descender 1 with a safety harness 28, for a combined, all-in-one fall-protection system, because it can be positioned in the area of the small of the back of the harness 28, where it can be worn comfortably, and without being unduly cumbersome. Such integration renders the combined emergency descender system and harness are more user friendly, and provide greater motivation for people who need such fall protection harnesses and self-rescue capability to wear the equipment willingly.

Figure 12:
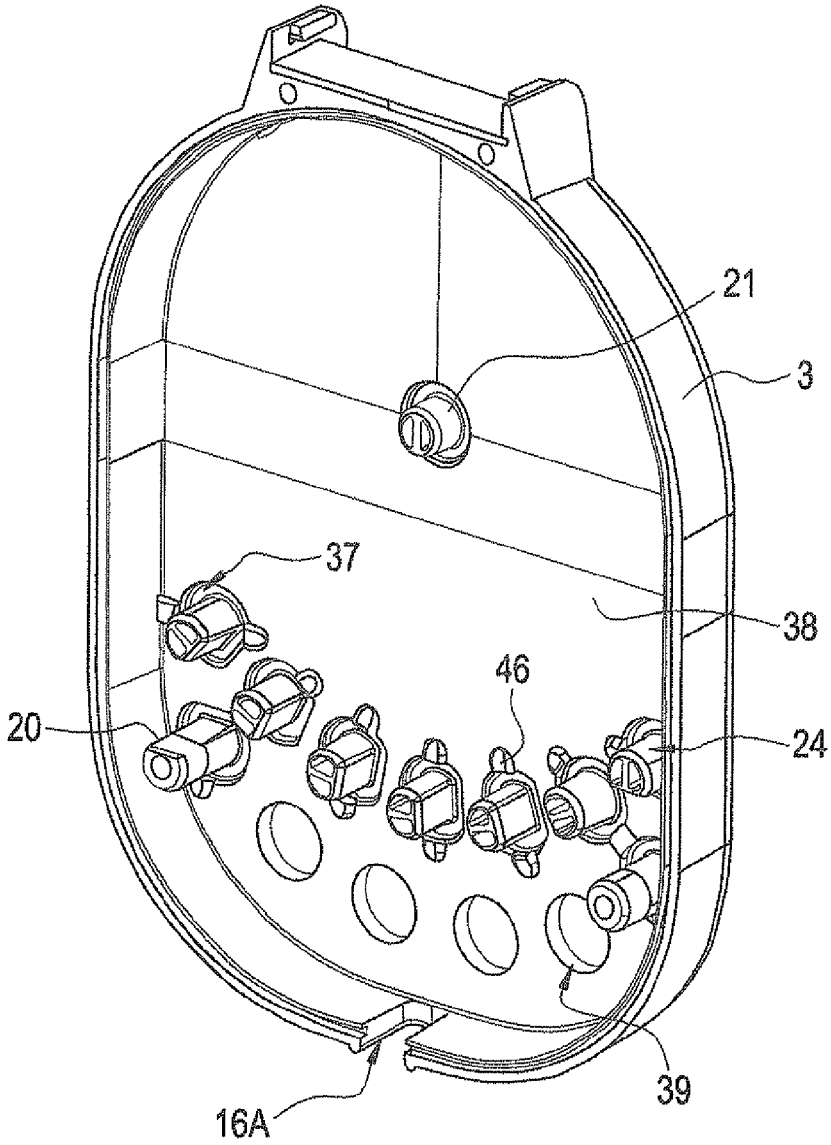
FIGS. 12 and 12A show a perspective view of the rear half of the enclosure of the descender module, revealing the moats and bosses which support the array of friction-inducing members. In addition, this view reveals the through-holes through which the array of large load-bearing friction bars are mounted to the plates on the outside of the enclosure halves, thereby effectively isolating the enclosure halves from the shock loads of fall impacts or descents of a wearer.
Figure 12A:
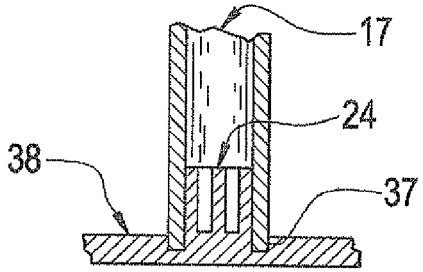

FIG. 12 illustrates a perspective view of the inside of the preferred embodiment as described in FIG. 11, and showing details of the mounting, support, and anti-rotation provisions for the friction-inducing members 17, including the bosses 24 and moat channels 37. Likewise, the holes 46 through which the load-bearing friction bars are mounted to the support plates 10 are illustrated. FIG. 12A reveals the mounting arrangement for the friction-inducing members 17, including the anti-rotation and support bosses 24, and the moat channels 37 which are countersunk into the interior planar wall surfaces of front enclosure half 2, and rear enclosure half 3.

Figure 12B:
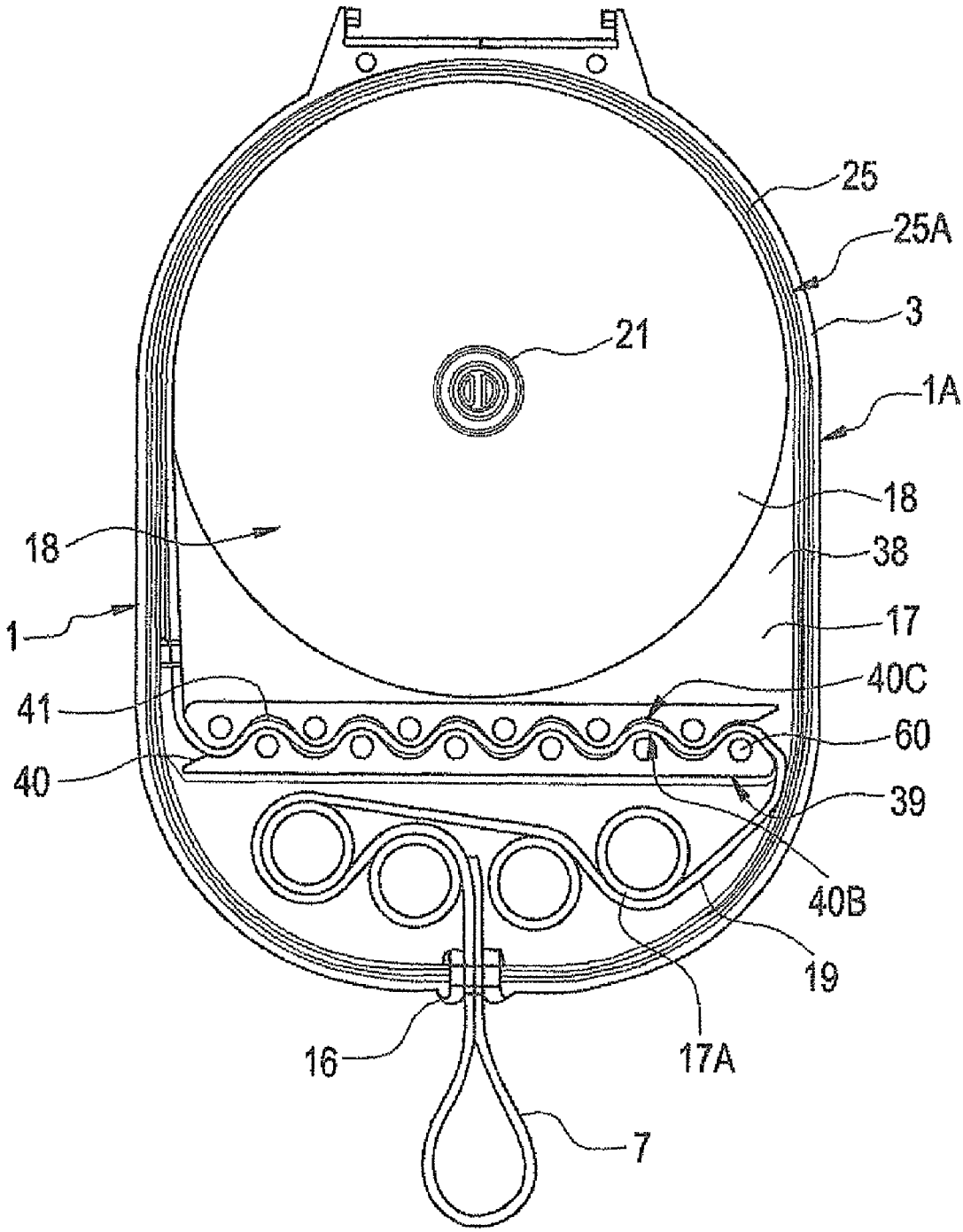
FIG. 12B shows another embodiment of the invention that employs the bar-containing braking unit shown in FIG. 10A and the load bearing members shown, for example, in FIG. 6.

FIG. 12B illustrates another preferred embodiment of the descender 1, wherein the array of friction inducing members positioned adjacent the stored descent line 18 comprises at least one pair of spaced apart braking bars 39 having inner surfaces 40 which mirror one another and which are equipped with a series of alternating convex lobes 40B and concave recesses 40C, such that the space 41 between such mating surfaces 40 comprises a convoluted path through which the descent line 7 passes, prior to passing through the array of load-bearing members 17A, during a descent of a user of the descender, and which alternating convex lobes 40B generate and induce frictional resistance upon the alternating surfaces of the descent line 7, to slow the passage of the descent line 7 through the array and therefore to restrict the rate of descent of the user to a safe, controlled velocity. Also shown are tubular openings 60 within the braking bars 39, which openings 60 are provided for weight reduction and improved dissipation of the heat of friction generated during a descent, as compared to solid members.

Figure 13:
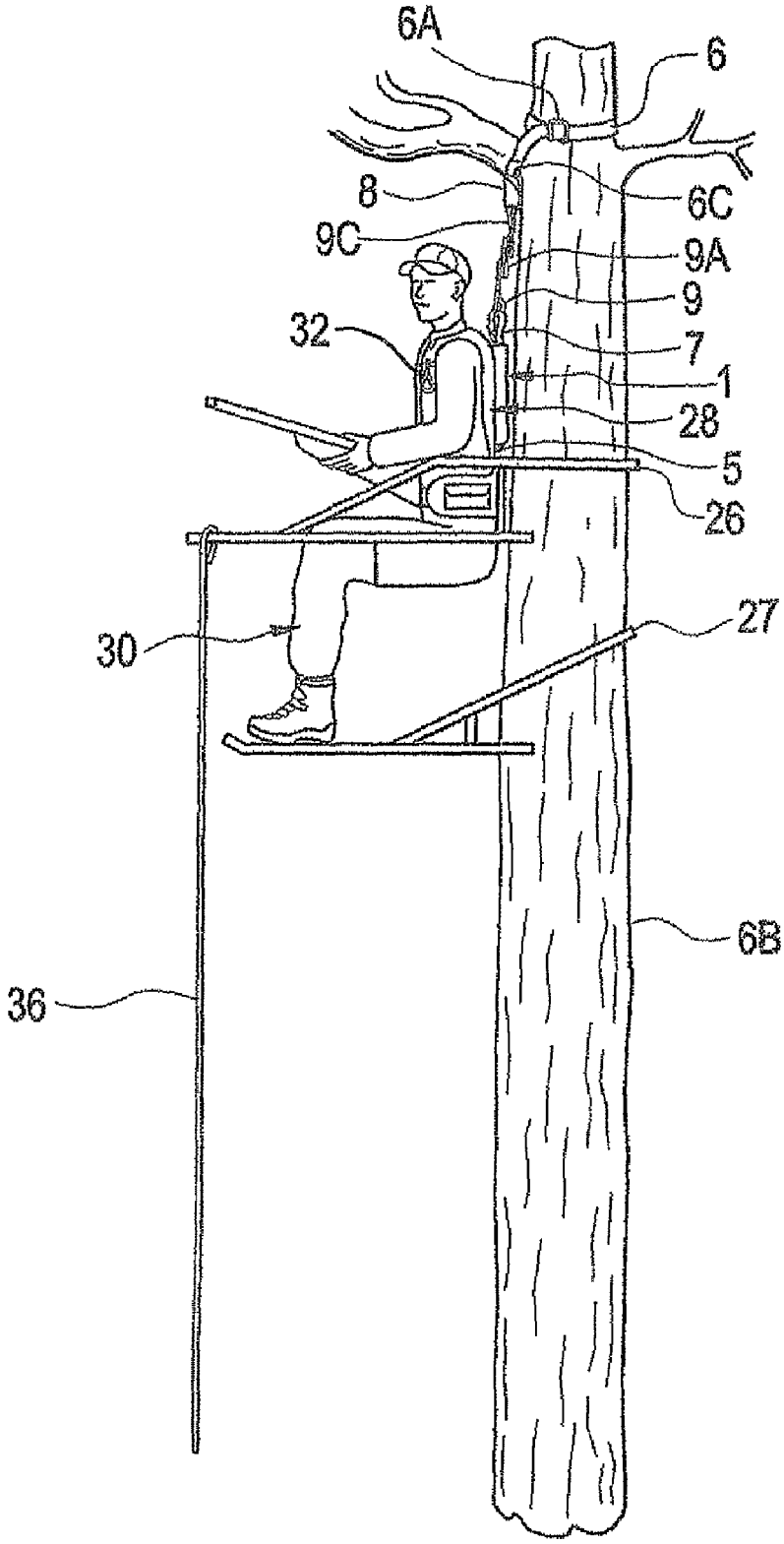
FIG. 13 is a perspective view of a preferred embodiment of the invention, showing a hunter hunting in a climbing treestand affixed to a tree, the hunter wearing a fall-arresting safety harness to which is attached a preferred embodiment of the invention, with a shock absorbing tether leading upward from the descender module of the invention, and connected via a carabiner to a tree-attachment anchor strap.

FIG. 13 illustrates a hunter 30 hunting from a treestand 26, 27, who is using the emergency descender system 1 inverted and attached to a safety harness 28. Also revealed are a line 36 which may be used both for hoisting or lowering hunting gear, and for measuring the height above the ground, to ensure that the emergency descender 1 is mounted at a height that is not too far above the ground to permit the hunter to reach the ground with his feet in the event of a fall and a subsequent controlled descent. Likewise, the terminal end 7 of the descent line 19 is visible, as it connects to the shock-absorbing tether 9, with its tear-away shock absorber strips 9A, and the terminal end of which tether 9 is attached via a carabiner and a loop to an anchor strap 6 which is secured via a connector 6A to a tree 6B.

FIG. 13 also shows a handle 32 on the front of the shoulder strap of the harness which represents a controller for a manual release, start, and stop mechanism which may be incorporated into the emergency descender 1. Such manual start-and-stop capability may be required in industrial and commercial applications. For hunting applications, operation of the emergency descender 1 is fully automatic, being initiated by the application of more than 90 pounds of force on the descent line, sufficient to pop the grommet 16 out of the grommet hole 16A. This permits even an unconscious hunter 30, as in one who may have experienced a heart attack, fainting spell, seizure, or other illness or injury resulting in the inability of the fallen hunter to initiate a safe descent through his own actions, thereby preventing the accidental onset of suspension trauma to a suspended, but unconscious or incapacitated user.

Figure 14:
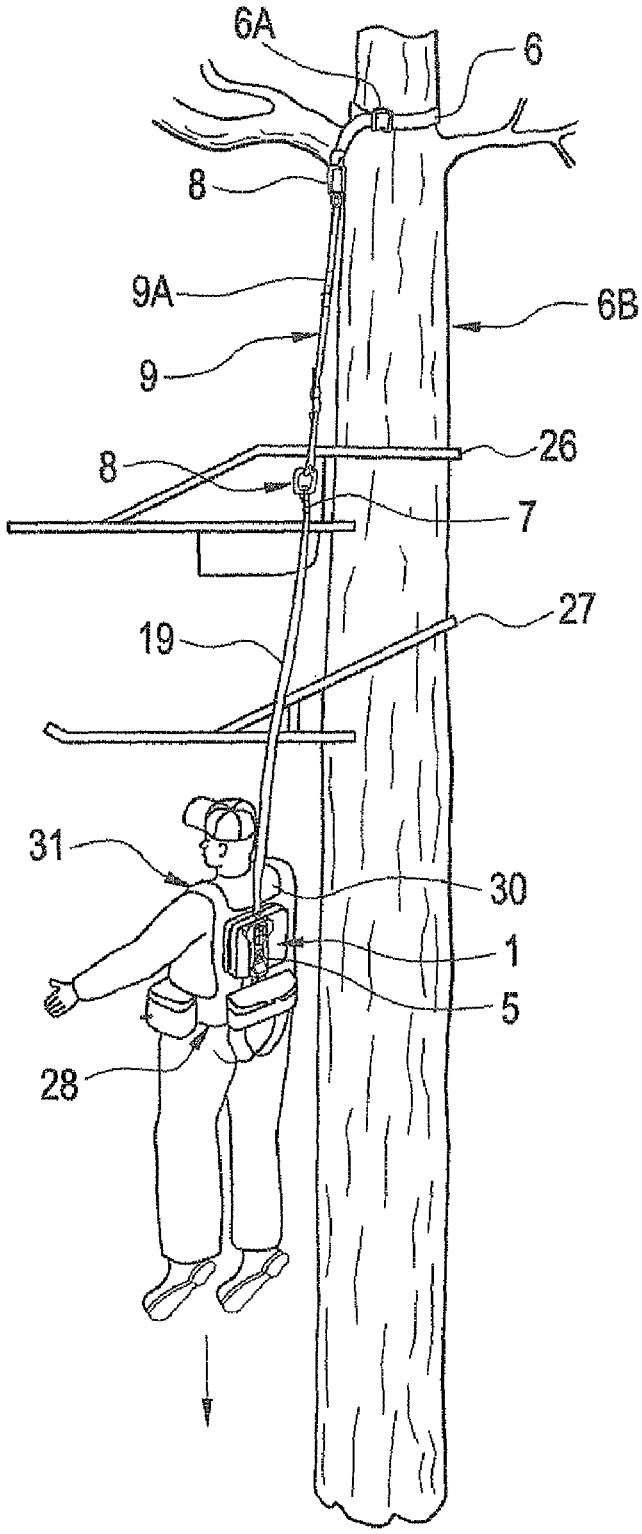
FIGS. 14 and 15 are perspective views of the hunter shown in FIG. 13, after having sustained an accidental fall, and after deployment of the shock-absorbing safety tether, and at two different positions during a controlled descent following such fall, wherein the descent line is being withdrawn at a controlled rate from the descender module to provide a comfortable and safe, gradual descent back to the ground.

FIG. 14 illustrates the emergency descender 1 as in FIG. 13, except that it reveals that the hunter 30 has sustained a fall and is in the process of descending gradually on descent line 19, which has been pulled from the coil of stored descent line 18 within the emergency descender 1. The descent rate of the hunter has been controlled by the frictional resistance imparted by the hunter's weight exerting force against the friction-inducing members 17.

Figure 15:
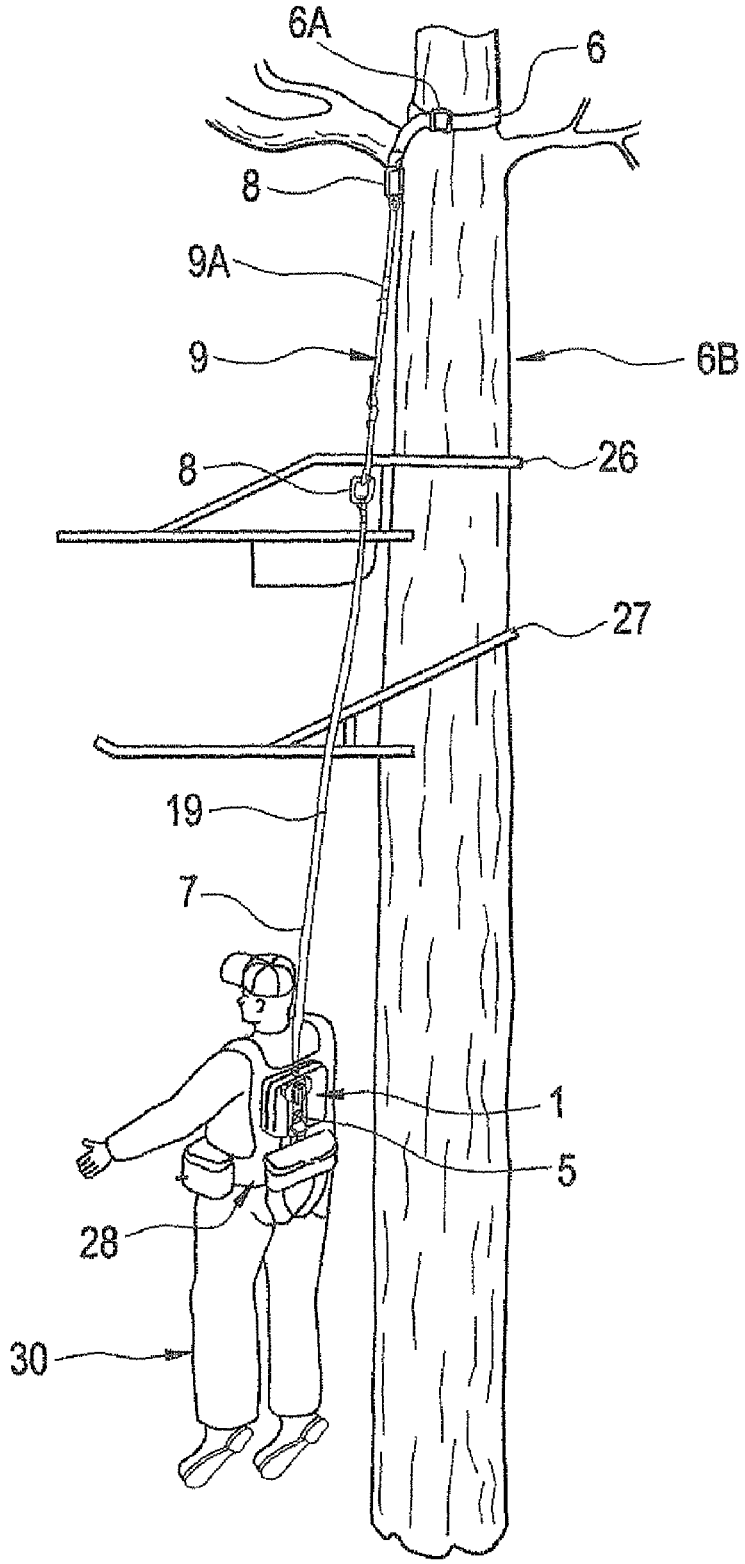

FIG. 15 is similar to FIG. 14, except that it illustrates the descending hunter 30 approaching a safe touch-down on the ground after experiencing a fall that was arrested by the safety harness 28, and a subsequent smooth and gentle descent at a controlled safe rate afforded by the emergency descender 1 of the invention.

FIG. 10D is also representative of another embodiment of the invention, wherein the braking unit is used on its own. In this regard, FIG. 10D is shown with an attachment means, i.e., a ring 75 that is mounted to the one of the openings 60 in the bar 39. It should be understood that the attachment means as the ring can be mounted at either end, the center, or a combination of locations on the braking unit to facilitate the attachment of the unit in an elevated position, e.g., a tree or the like. In addition, the attachment means for supporting the braking unit can be other devices, a strap, a carabiner, or virtually any mechanical device that can link to the bar or bars and be used for support.

Figure 10G:
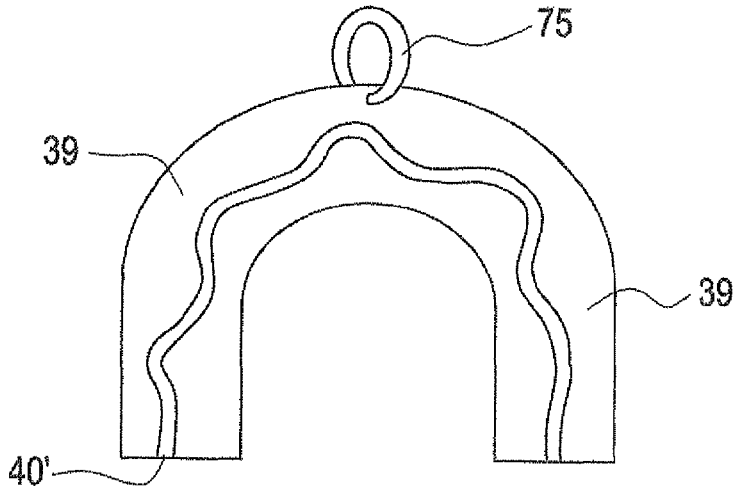
Figure 10H:
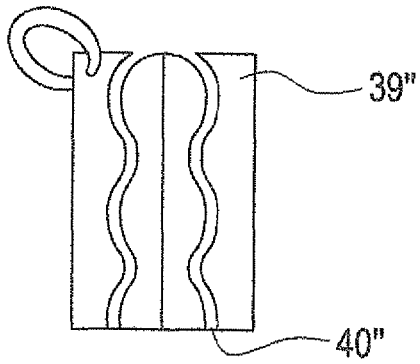
Figure 10I:
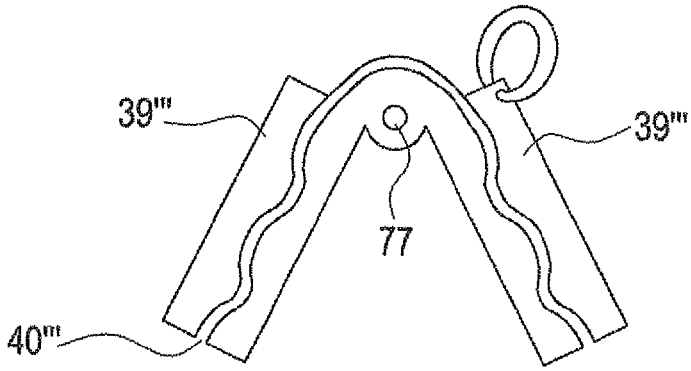

FIGS. 10G-I show alternative and schematic configurations of the bars 39 of FIG. 10 D. It should be understood that FIGS. 10G-I only show the bars consistent with FIG. 10D and omits the other components of the braking unit as shown and described in other drawings and parts of the description of the invention. While the bars themselves extend longitudinally in one direction in FIG. 10D, the bars 39' can be curved as shown in FIG. 10G with the space 40' at the terminal end of the bars being directed in the same direction. The attachment means as a ring 75 is also illustrated. Another embodiment is shown in FIG. 10H, wherein the two pairs of bars 39" are shown in parallel or a back to back relationship with spaces 40". One other embodiment shows the pairs of bars 39''' in an angled configuration with pivot 77, whereby the pivot could be lockable at different angles to adjust the inclination between the two bars 39'''. Of course, the angled bars could also be fixed in a permanent angle is so desired. In any of the above embodiments described above, the braking unit has an overall longitudinal axis that follows a particular path notwithstanding the convoluted mating surface between the two bars. In FIG. 10D, the axis is generally straight, with FIG. 10G displaying the axis along a curved path. The path is angled in FIG. 10I.

The embodiments disclosed in FIGS. 10D, and 10H-I can be used in two different fashions. In one embodiment, the braking unit comprising at least one pair of braking bars held together by at least one pair of side bars, with the alternating lobes and recesses of the braking bars comprising a convoluted pathway has the descent line positioned therebetween. The descent line has its upper end attached to a tree or other elevated anchor point, and a lower end which extends freely to the ground or other lower place of safety. This could be envisioned with respect to FIG. 10D, wherein one end of the descent line 7 is attached to the tree and the other end exiting the braking unit is free and extends to the ground. In this embodiment, the braking unit is equipped with attachment means to attach the braking unit to a safety harness worn by a user of the system, as is shown in FIG. 10A. In this regard, this embodiment is similar to that shown in FIG. 10A except that the descent line would be configured to fall to the ground instead of being coiled in the container. In the event of a fall or descent by the user, the user's weight will cause the braking unit to travel downward as it is pulled over the descent line, at a controlled, safe velocity as a result of the frictional resistance which is induced when the webbing rubs against the alternating male lobes of the braking unit as the descent progresses. When the user reaches the ground or a lower place of safety where he or she can stand, the braking unit, which has slid down the descent line during the descent, is still attached to the safety harness and slidably attached to the descent line. In this mode, the braking unit has the descent line mounted at an elevated location and the user with the braking unit linked thereto by a harness or the like is pulled down the line by the user's weight during descent.

In another embodiment, the braking unit is mounted to an elevated location/anchor point to function as a for two-way operation, permitting use by multiple persons in sequence: In this embodiment, the braking bars can be configured to comprise an inverted "U" shape as shown in FIG. 10G, with the braking unit attached to an upper, elevated anchor point by means of a ring, threaded link, or other attachment device, see 7 in FIG. 1 for example, such that a length of descent line extends from a lower place of safety upward, through and between the braking bars and along the convoluted path, and terminates in another loop or mechanical attachment means at the opposite end of the braking unit, which could be similar to the attachment device at the other end of the line. A user, in order to achieve a safe descent in the event of a fall or other need to escape from such elevated location, attaches the tether of a harness, safety belt, or other fall arrest system worn by the user, to the mechanical connecting means, e.g., loop, at the end of the descent line, thereafter placing his or her weight on the descent line and commencing a controlled descent to the ground or other safe lower location. As the descent progresses, the free length of the descent line is pulled upward, into, and through the braking unit, and passes out of the braking unit at its opposite end, gradually lowering the user to the ground or a lower place of safety. When a first user has descended, a second user can descend as described, using the attachment device, e.g., loop, at the opposite end of the descent line. Such sequential use can continue in order to lower, one after the other, a group of users from the elevated location to the ground or lower place of safety, without any need to re-load the line prior to use by subsequent users. Such line can theoretically be of any length, in order to provide escape or descent capability from a range of heights.

FIG. 10H has the same capability of permitting a number of people to descend as described above for FIG. 10G, just that the braking unit is not curved but arranged in a back to back relationship. Here, the descent line would emerge from the space of one of the pairs of bars and enter the space of the other pair of bars during use. A similar use could be applied for the unit of FIG. 10I.

The braking unit can include a cover or housing, to protect it from weather. The cover or housing can take any shape or configuration as long as its construction keeps the elements away from the braking unit.

As such, an invention has been disclosed in terms of preferred embodiments thereof which fulfills each and every one of the objects of the present invention as set forth above and provides a new and improved descender system.

Of course, various changes, modifications and alterations from the teachings of the present invention may be contemplated by those skilled in the art without departing from the intended spirit and scope thereof. It is intended that the present invention only be limited by the terms of the appended claim.

I claim:

1. An emergency descender system comprising:

a housing having first and second mating halves attached together, inside which housing are mounted at least one friction inducing assembly defining a convoluted path and an array of load-bearing members that are non-rotating and friction inducing, and a coil of descent line, the coil of descent line having a first end located at the center of the coil, and attached to a spindle to permit free rotation of the coil, and therefore free entry of such descent line into the at least one friction inducing assembly, the coil having a second end which terminates in a loop or other mechanical attachment beyond the at least one friction inducing assembly and array of load-bearing members, and a load-bearing and load-transfer yoke, comprising a pair of load-bearing plates attached to the load-bearing members; and a pair of straps, one end of each strap attached to a respective load-bearing plate, each strap extending from an attachment point on the plate to one end of the housing, the straps joined together to form a terminal end that is adapted for attachment to an anchor point on a tree or other elevated structure, wherein the at least one friction inducing assembly is configured to permit passage of the descent line in the convoluted path such that when the descent line is pulled through the convoluted path, friction is generated, sufficient to slow down the descent of a person wearing a safety harness attached to the descender, to ensure a controlled descent at a safe speed.

2. The system of claim 1, wherein the housing includes a grommet for sealing the housing to protect an inside of the housing from effects of weather.

3. The system of claim 1, where the housing includes a perimeter seal where the two mating halves meet to protect an inside of the housing from effects of weather.

4. The system of claim 1, where the descent line comprises a braided or woven webbing made from a polymer selected from the group consisting of nylon, polyester, polypropylene, Spectra, Mylar and Kevlar.

5. The system of claim 4, where the amount of descent line stored in the housing ranges from about 15 feet to about 250 feet.

6. The system of claim 4, where the width of the descent webbing ranges from about ½" to about 2".

7. The system of claim 4, where the thickness of the descent webbing ranges from about 0.025" to about 0.125".

8. The system of claim 1, where the load-bearing plates and yoke are mounted outside of the mating halves of the housing, with loads transferred to the plates and yoke through fasteners used to join the load-bearing plates to the load bearing members.

9. The system of claim 8, where each strap is comprised of a length of braided or woven webbing attached by sewn loops to the plate, and a midsection of which is sewn into a loop at the end of the housing opposite the plates, to receive attachment of hardware for mounting the descender system to an anchor point on a tree or other elevated structure.

10. The system of claim 1, where the terminal end of the yoke has a loop fitted with one half of an interlocking buckle which mates with a corresponding second half of such buckle, which second half is attached to a sewn loop attached to a belt equipped with fastening means, which belt is securely attached to a tree or other elevated structure, comprising an anchor point permitting quick attachment or detachment of the descender system by means of the interlocking buckles.

11. The system of claim 1, wherein the at least one friction inducing assembly further comprises a braking unit mounted within the housing, the braking unit comprising at least two mating braking bars having alternating convex lobes and recesses along the length of their mating, spaced apart surfaces, which convex lobes generate frictional resistance as the descent line passes among them during a descent, to control and restrict the rate of descent of a wearer to a safe velocity.

12. The system of claim 11, wherein the braking bars are formed of a machined or extruded material, and wherein the braking bars include tubular openings to permit the rapid dissipation of heat during a descent and also reduce weight of the braking unit.

13. A descender and harness combination comprising:

a safety harness adapted to support a person in an elevated position, and the descender system of claim 1, wherein the yoke is attached to the safety harness such that the descender is positioned above the yoke attachment, and the second end of the descent line that emerges from the housing at the opposite end thereof is oriented to be above the descender and the harness for attachment to an anchor point on a tree or other elevated structure, such that in the event of a fall, the descender remains with the harness, and the descent line is pulled out of the descender during a controlled descent of the wearer back to the ground or other safe platform.

14. The system of claim 1, where the at least one friction inducing assembly comprises an array of friction inducing members.

15. The system of claim 14, where the friction-inducing members are tubular, having an elliptical cross-section to permit non-rotatable mounting, and constructed of machined or extruded metal.

16. The system of claim 14, where the friction-inducing members are tubular, having generally round outer and inner surfaces having one or more flat surface segments on such outer and inner surfaces, to permit non-rotatable mounting of such tubular friction-inducing members, and wherein such friction-inducing members are constructed of machined or extruded metal.

* * * * *